US011304577B2

(12) United States Patent
Lee et al.

(10) Patent No.: US 11,304,577 B2
(45) Date of Patent: Apr. 19, 2022

(54) CLEANER

(71) Applicant: Samsung Electronics Co., Ltd, Suwon-si (KR)

(72) Inventors: Dong Hyun Lee, Suwon-si (KR); Young Jun Cho, Suwon-si (KR); Jin Ho Lee, Suwon-si (KR); Ki-Man Kim, Suwon-si (KR); Jong Gook Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 269 days.

(21) Appl. No.: 16/777,701

(22) Filed: Jan. 30, 2020

(65) Prior Publication Data

US 2020/0245833 A1 Aug. 6, 2020

(30) Foreign Application Priority Data

Jan. 31, 2019 (KR) ..... 10-2019-0012711

(51) Int. Cl.

| | |
|---|---|
| ***A47L 9/14*** | (2006.01) |
| ***A47L 5/28*** | (2006.01) |
| ***A47L 9/10*** | (2006.01) |

(52) U.S. Cl.

CPC ..... *A47L 9/1463* (2013.01); *A47L 5/28* (2013.01); *A47L 9/102* (2013.01); *A47L 9/106* (2013.01)

(58) Field of Classification Search

CPC ... A47L 5/26; A47L 5/28; A47L 9/102; A47L 9/106; A47L 9/1409; A47L 9/1445; A47L 9/1463; A47L 9/1481; A47L 9/1683; A47L 9/1691

See application file for complete search history.

(56) References Cited

U.S. PATENT DOCUMENTS

| | | | | |
|---|---|---|---|---|
| 10,376,115 | B2 * | 8/2019 | Han | A47L 9/20 |
| D927,803 | S * | 8/2021 | Zou | D32/18 |
| D930,296 | S * | 9/2021 | Song | D32/18 |
| 2008/0172993 | A1 * | 7/2008 | Yun | A47L 9/1683 55/337 |

(Continued)

FOREIGN PATENT DOCUMENTS

| | | | | |
|---|---|---|---|---|
| EP | 1839758 | A1 * | 10/2007 | A47L 9/108 |
| EP | 1839758 | A1 | 10/2007 | |

(Continued)

OTHER PUBLICATIONS

Notice of Preliminary Rejection dated Jun. 13, 2019 in connection with Korean Patent Application No. 10-2019-0012711, 5 pages.

(Continued)

*Primary Examiner* — Marc Carlson

(57) ABSTRACT

A cleaner capable of separating a dust separator from a main body and separating a dust container from the dust separator by using a button. The cleaner includes: a main body; a dust separator detachably coupled to the main body configured to separate dust contained in air; a dust container detachably coupled to the dust separator; and a button configured to separate the dust separator from the main body and separate the dust container from the dust separator, when the dust separator is separated from the main body.

20 Claims, 28 Drawing Sheets

(56) References Cited

U.S. PATENT DOCUMENTS

| | | | | |
|---|---|---|---|---|
| 2011/0289720 | A1* | 12/2011 | Han | A47L 9/165 15/344 |
| 2014/0059799 | A1* | 3/2014 | Kim | A47L 9/1683 15/353 |
| 2016/0287042 | A1* | 10/2016 | Han | A47L 9/1683 |
| 2017/0258282 | A1* | 9/2017 | Shinagawa | A47L 9/2857 |
| 2018/0289227 | A1* | 10/2018 | Takano | A47L 9/0081 |
| 2019/0208974 | A1* | 7/2019 | Oka | A47L 9/246 |
| 2020/0405109 | A1* | 12/2020 | Okitsu | A47L 9/1625 |

FOREIGN PATENT DOCUMENTS

| | | | |
|---|---|---|---|
| EP | 1949967 | A2 | 7/2008 |
| EP | 2702914 | A2 | 3/2014 |
| EP | 3075297 | A1 | 10/2016 |
| JP | 2015093021 | A | 5/2015 |
| JP | 2017164026 | A | 9/2017 |
| KR | 20010029067 | A | 4/2001 |
| KR | 20010046138 | A | 6/2001 |
| KR | 20020004469 | A | 1/2002 |
| KR | 20110132193 | A | 12/2011 |
| KR | 20180023272 | A | 3/2018 |

OTHER PUBLICATIONS

Notice of Allowance dated Oct. 29, 2019 in connection with Korean Patent Application No. 10-2019-0012711, 2 pages.

European Search Report dated Jun. 15, 2020 in connection with European Patent Application No. 20 15 3276, 5 pages.

* cited by examiner

CLEANER

CROSS-REFERENCE TO RELATED APPLICATION

This application is based on and claims priority under 35 U.S.C. § 119 to Korean Patent Application No. 10-2019-0012711 filed on Jan. 31, 2019 in the Korean Intellectual Property Office, the disclosure of which is incorporated by reference herein in its entirety.

BACKGROUND

1. Field

The disclosure relates to a cleaner, and more particularly, to a cleaner including a button for separating a dust separator from a main body and separating a dust container from the dust separator.

2. Description of Related Art

In general, a cleaner is a home appliance that sucks air containing foreign substances such as dust using a suction force generated by a motor installed inside a main body, separates the foreign substances contained in the air by a dust separator, and then discharges the air from which the foreign substances have been removed to the outside.

The cleaner includes a main body in which the motor is installed, and a dust collector detachably coupled to the main body. The dust collector includes a dust separator, and a dust container detachably coupled to the dust separator.

In general, the cleaner includes a button for separating the dust separator from the main body and a button for separating the dust container from the dust separator. In this case, a user needs to operate the buttons according to situations by learning the functions of the buttons, which deteriorates ease of use. In addition, because spaces for installing the buttons are required, utilization of space may be lowered.

Also, in a process of separating the dust container from the main body, the dust container may fall to the floor due to its own weight contrary to a user's intention. Furthermore, when the dust container falls to the floor, dust inside the dust container may pour to the outside, and in this case, cleaning needs to be again performed.

SUMMARY

It is an aspect of the disclosure to provide a cleaner capable of separating a dust separator from a main body and separating a dust container from the dust separator by using a button.

It is another aspect of the disclosure to provide a cleaner capable of preventing a dust container from being separated from a dust separator when a dust collector is separated from a main body.

It is another aspect of the disclosure to provide a cleaner capable of coupling a dust collector to a main body in various directions.

It is another aspect of the disclosure to provide a cleaner capable of preventing a dust container from falling down due to a user's carelessness when the dust container is separated.

It is another aspect of the disclosure to provide a cleaner including a dust container fixer capable of preventing the dust container from falling down when the dust container is decoupled from a main body.

Additional aspects of the disclosure will be set forth in part in the description which follows and, in part, will be obvious from the description, or may be learned by practice of the disclosure.

In accordance with an aspect of the disclosure, a cleaner includes: a main body; a dust separator detachably coupled to the main body, and configured to separate dust contained in air; a dust container detachably coupled to the dust separator; and a button configured to separate the dust separator from the main body and separate the dust container from the dust separator when the dust separator is separated from the main body.

The button may include: a first protrusion configured to fix or release the dust separator to or from the main body; and a second protrusion configured to fix or release the dust container to or from the dust separator.

The main body may include a first locking portion which the first protrusion is inserted into or taken out of, and the dust container may include a second locking portion which the second protrusion is inserted into or taken out of.

The button may further include a third protrusion configured to restrict a movement range of the button by coming into contact with a stopper provided in the main body.

The third protrusion may be further configured to restrict the movement range of the button such that the second protrusion is not taken out of the second locking portion, when the dust separator is separated from the main body.

The button may be further configured to be rotatable in a first direction such that the first protrusion is taken out of the first locking portion or the first protrusion and the second protrusion are taken out of the first locking portion and the second locking portion.

The cleaner may further include an elastic member configured to provide an elastic force to the button such that the button rotates in a second direction that is opposite to the first direction.

The main body may include a sliding groove extending in the first direction.

The dust container may include a sliding protrusion inserted into the sliding groove.

The sliding protrusion may be inserted into the sliding groove by sliding in the first direction or may be inserted into the sliding groove by moving in a second direction intersecting the first direction.

The sliding protrusion may be further configured to be movable in a third direction intersecting the first direction and the second direction and to return to an original position by the elastic force.

The sliding protrusion may be further configured to return to the original position after moving in the third direction, when the sliding protrusion moves in the second direction to be inserted into the sliding groove.

The button may include the first protrusion configured to restrict a movement of the dust separator in the first direction.

The sliding protrusion may be further configured to restrict the movement of the dust separator in the second direction.

The first locking portion may include a stopper, a protrusion extending from the stopper, and a protrusion groove formed by the protrusion, wherein the first protrusion is inserted into the protrusion groove.

The second locking portion may include a button hole formed in an outer surface of the dust container, wherein the second protrusion is inserted into the button hole.

In accordance with another aspect of the disclosure, a cleaner includes: a main body configured to suck air; a dust separator detachably coupled to the main body, and configured to separate dust in the air sucked into the main body; a dust container detachably coupled to the dust separator and storing dust; and a button including a first protrusion configured to fix or release the dust separator to or from the main body, and a second protrusion configured to fix or release the dust container to or from the dust separator.

The main body may include a protrusion groove which the first protrusion is inserted into.

The dust container may include a button hole which the second protrusion is inserted into.

The button may further include a third protrusion configured to restrict a movement range of the button by coming into contact with a stopper portion provided in the main body.

When the first protrusion is taken out of the protrusion groove such that the dust separator is separated from the main body, the third protrusion may restrict the second protrusion from being taken out of the button hole.

The dust container may include a sliding protrusion coupled to a sliding groove provided in the main body.

The sliding protrusion may be coupled to the sliding groove by sliding in a first direction in which the sliding groove extends, or may be coupled to the sliding groove by moving in a second direction intersecting the first direction.

In accordance with another aspect of the disclosure, a cleaner includes: a main body; a dust separator detachably coupled to the main body; a dust container detachably coupled to the dust separator, and configured to be restricted from being separated from the dust separator when the dust separator is coupled to the main body; and a button provided in the dust separator, and configured to fix or release the dust separator to or from the main body and fix or release the dust container to or from the dust separator.

A dust container assembly may include the dust separator and the dust container.

The cleaner may further include a dust container fixer configured to prevent the dust container assembly from falling down by the weight of the dust container assembly when the dust container assembly is released from the main body by the button.

The dust container fixer may include: a sliding groove extending in a first direction and provided in the main body; a sliding protrusion configured to be inserted into the sliding groove to be slidable along the first direction and provided in the dust container; and a latching protrusion provided at one end of the sliding groove to restrict a movement of the sliding protrusion in the first direction.

When the dust container assembly is released from the main body by the button, the dust container assembly may be prevented from falling down by a weight of the dust container assembly due to the sliding protrusion caught by the latching protrusion, and the dust container assembly may be separated from the main body in the first direction when a predetermined force that is greater than the weight of the dust container assembly is applied to the dust container assembly in the first direction.

The sliding protrusion may be further configured to be movable in a second direction intersecting the first direction.

The sliding protrusion may be further configured to pass through the latching protrusion by moving in the second direction.

The main body may further include a sliding rail forming one surface of the sliding groove and extending in the first direction.

The sliding protrusion may be further configured to pass through the sliding rail and be inserted into the sliding groove by moving in a third direction intersecting each of the first direction and the second direction.

The sliding protrusion may be further configured to pass through the sliding rail by moving in the second direction, when the sliding protrusion is inserted into the sliding groove in the third direction.

The sliding protrusion may include: a first guide surface inclined with respect to the first direction to slide to pass through the latching protrusion; and a second guide surface inclined with respect to the third direction to slide to pass through the sliding rail.

In accordance with another aspect of the disclosure, a cleaner includes: a main body; a dust separator detachably coupled to the main body; a dust container detachably coupled to the dust separator, and configured to be restricted from being separated from the dust separator when the dust separator is coupled to the main body; a button provided in the dust separator, and configured to fix or release the dust separator to or from the main body and fix or release the dust container to or from the dust separator; and a dust container fixer configured to prevent the dust container and the dust separator from falling down by weights of the dust container and the dust separator when the dust container and the dust separator are released from the main body by the button.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 28, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations shown in the embodiments and the drawings described in the specification are only the preferred embodiments of the disclosure, and thus it is to be understood that various modified examples, which may replace the embodiments and the drawings described in the specification, are possible when filing the application.

The terms used in the specification are used to describe the embodiments of the disclosure. Accordingly, it should be apparent to those skilled in the art that the following description of exemplary embodiments of the disclosure is provided for illustration purpose only and not for the purpose of limiting the disclosure as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that although the terms first, second, etc. may be used herein to describe various components, these components should not be limited by these terms, and the terms are only used to distinguish one component from another. For example, without departing from the scope of the disclosure, the first component may be referred to as a second component, and similarly, the second component may also be referred to as a first component.

In addition, directions such as "upward," "downward," "sideward," etc. used in the specification are described with reference to the drawings for convenience of description and do not indicate a specific direction.

Hereinafter, embodiments of the disclosure will be described in detail with reference to the accompanying drawings.

Figure 1:
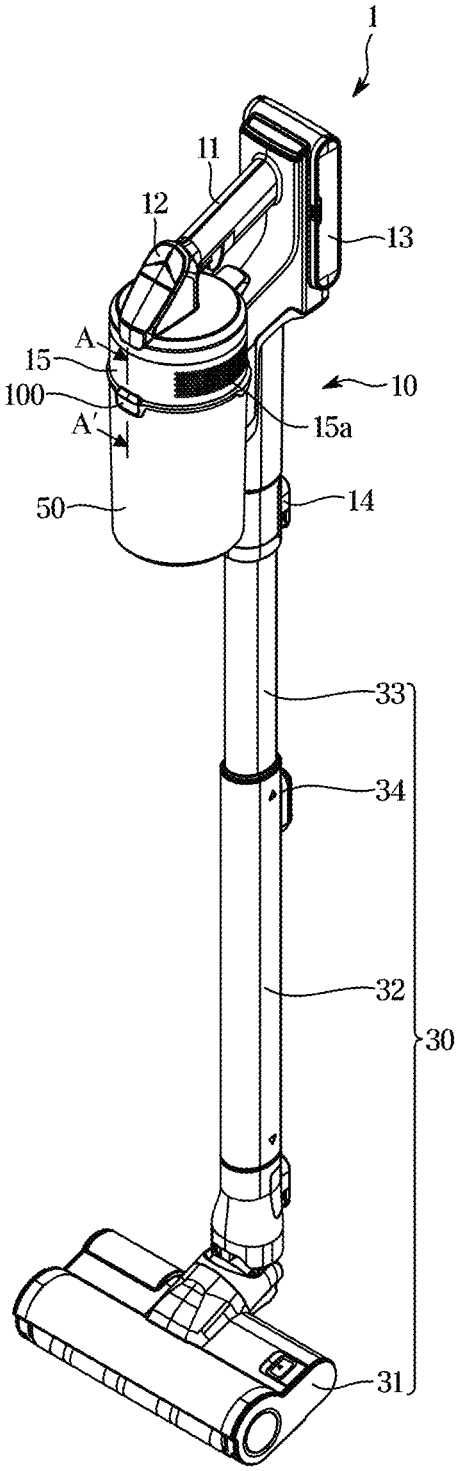
FIG. 1 illustrates a perspective view of a cleaner according to an embodiment of the disclosure.
Figure 2:
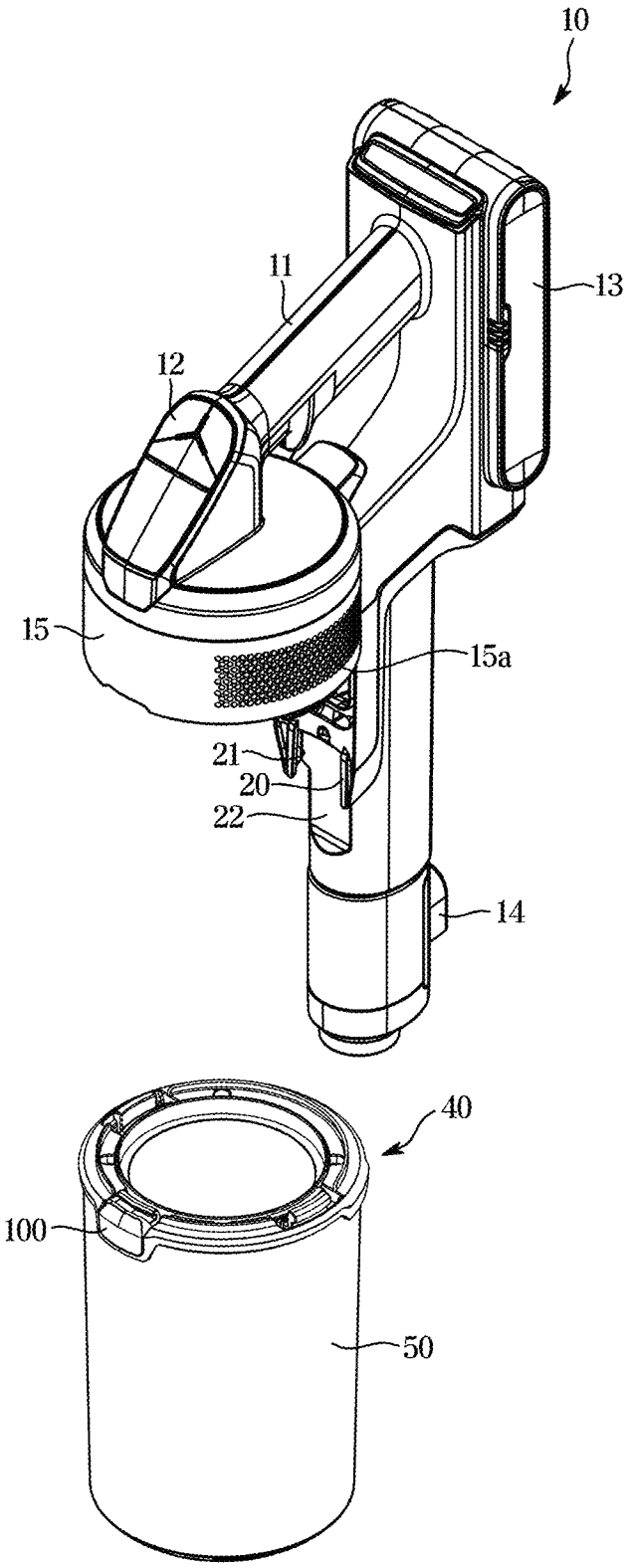
FIG. 2 illustrates a main body and a dust collector separated from the main body in a cleaner according to an embodiment of the disclosure.
Figure 3:
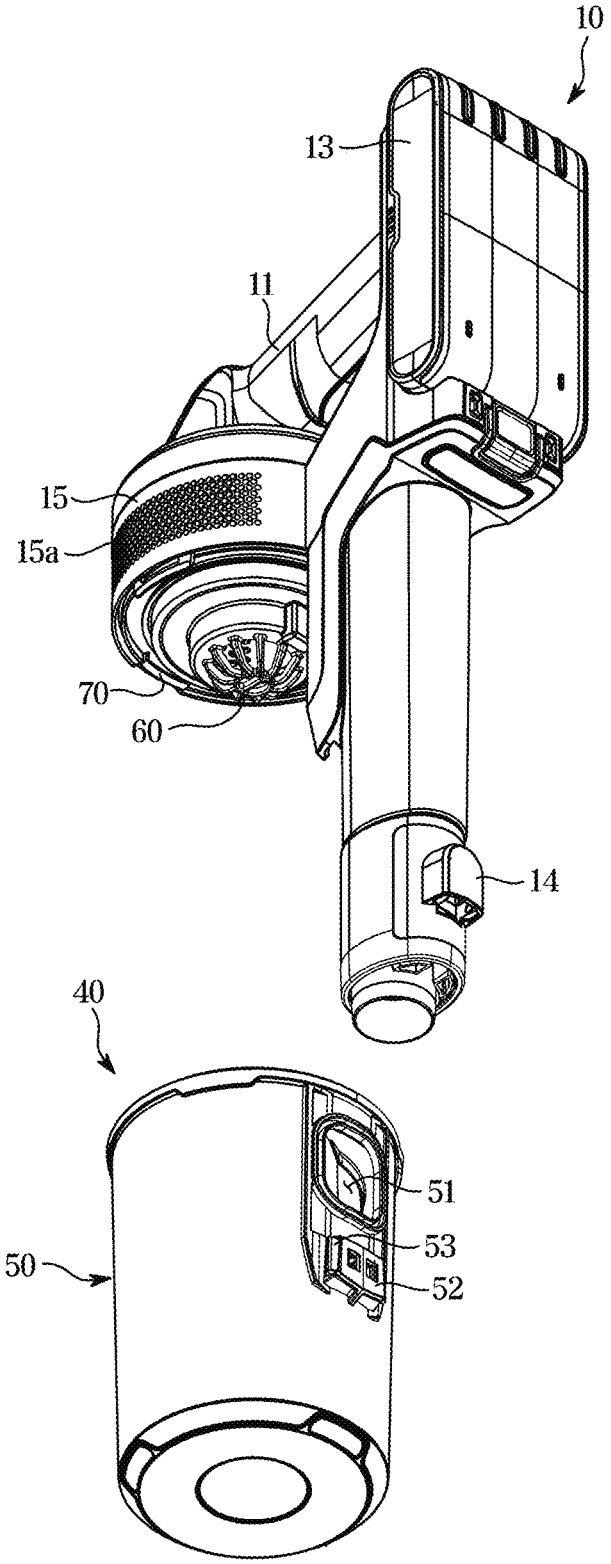
FIG. 3 illustrates the main body and the dust collector shown in FIG. 2 at another angle.

FIG. 1 illustrates a perspective view of a cleaner according to an embodiment of the disclosure, FIG. 2 illustrates some components of the cleaner according to an embodiment of the disclosure, and FIG. 3 illustrates some components of the cleaner shown in FIG. 2 at another angle.

A cleaner 1 may include a main body 10, dust collectors 40 and 50 detachably coupled to the main body 10, and a suction device 30 detachably coupled to the main body 10.

The main body 10 may include a motor configured to generate a suction force. The motor may be positioned inside a motor housing 60.

The dust collectors 40 and 50 may be positioned upstream of the motor, and may separate and store dust or foreign substances contained in air entering a suction port 51 through the suction device 30. The dust collectors 40 and 50 may include a dust separator 40 configured to separate dust or foreign substances contained in air entered through the suction device 30, and a dust container 50 configured to store the dust or foreign substances separated by the dust separator 40.

As shown in FIGS. 1 to 3, the dust collectors 40 and 50 may be detachably coupled to the main body 10.

The dust container 50 may include the suction port 51 which air sucked by the suction device 30 enters. The dust container 50 may include a protrusion housing 52, and a sliding protrusion 53 slidingly coupled to or inserted into the main body 10. A detailed description about the protrusion housing 52 and the sliding protrusion 53 will be given later.

The main body 10 may include a handle 11 to allow a user to grip and control the cleaner 1. The user may grip the handle 11 and move the cleaner 1 in front and rear directions.

The main body 10 may include a controller 12. The user may operate a power button or the like provided on the controller 12 to turn on/off the cleaner 1 or adjust a suction force.

The main body 10 may include a battery 13. The battery 13 may be detachably coupled to the main body 10. Accordingly, after the battery 13 is exhausted, the battery 13 may be replaced by another charged battery to increase an operating time of the cleaner 1. Alternatively, the battery 13 may be integrated into the main body 10.

The main body 10 may include a filter housing 15. The filter housing 15 may have a substantially donut shape to accommodate a filter therein. There is no restriction on a type of the filter, however, for example, a HEPA filter may be positioned in the filter housing 15. The filter may filter ultrafine particles and the like not filtered by the dust separator 40. The filter housing 15 may include a plurality of holes 15*a* to allow air passed through the filter to be discharged to an outside of the cleaner 1.

The main body 10 may include a sliding rail 20, a sliding groove 21, and a guide portion 22 configured to couple the dust collectors 40 and 50 to the main body 10. A detailed description thereof will be given later.

The suction device 30 may include a suction head 31 and extension pipes 32 and 33.

The suction head 31 may come into contact with a surface to be cleaned to suck foreign substances such as dust existing on the surface to be cleaned.

The extension pipes 32 and 33 may connect the suction head 31 to the main body 10. One end of the extension pipes 32 and 33 may be pivotally connected to the suction head 31. Accordingly, the suction head 31 may perform a joint motion with respect to the extension pipes 32 and 33.

The extension pipes 32 and 33 may include the first extension pipe 32, the second extension pipe 33, and a length adjusting portion 34. A length by which the second extension pipe 33 is exposed to the outside may be adjusted through the length adjusting portion 34. By adjusting a total length of the extension pipes 32 and 33 through the length adjusting portion 34, a user may select a length of the extension pipes 32 and 33 according to his/her height. Conventionally, a long or short extension pipe has been used according to a user's height. However, in the disclosure, a user may adjust the length of the extension pipes 32 and 33 to his/her desired length. Therefore, ease of use of the cleaner 1 may be improved.

The main body 10 may include a suction device connecting portion 14. The suction device connecting portion 14 may separate the suction device 30 from the main body 10 or couple the suction device 30 to the main body 10. The cleaner 1 may include various types of suction devices, and each suction device may be detachably coupled to the main body 10 through the suction device connecting portion 14.

The dust separator 40 may include a button 100. The button 100 may separate the dust collectors 40 and 50 from the main body 10 or couple the dust collectors 40 and 50 to the main body 10. The button 100 may also separate the dust container 50 from the dust separator 40 or couple the dust container 50 to the dust separator 40 when the dust collectors 40 and 50 are separated from the main body 10. According to an embodiment of the disclosure, the button 100 may be used to separate the dust collectors 40 and 50 from the main body 10 and the dust container 50 from the dust separator 40. That is, a user may operate the button 100 to separate the dust collectors 40 and 50 from the main body 10 and the dust container 50 from the dust separator 40. Therefore, ease of use of the cleaner 1 may be improved.

Figure 4:
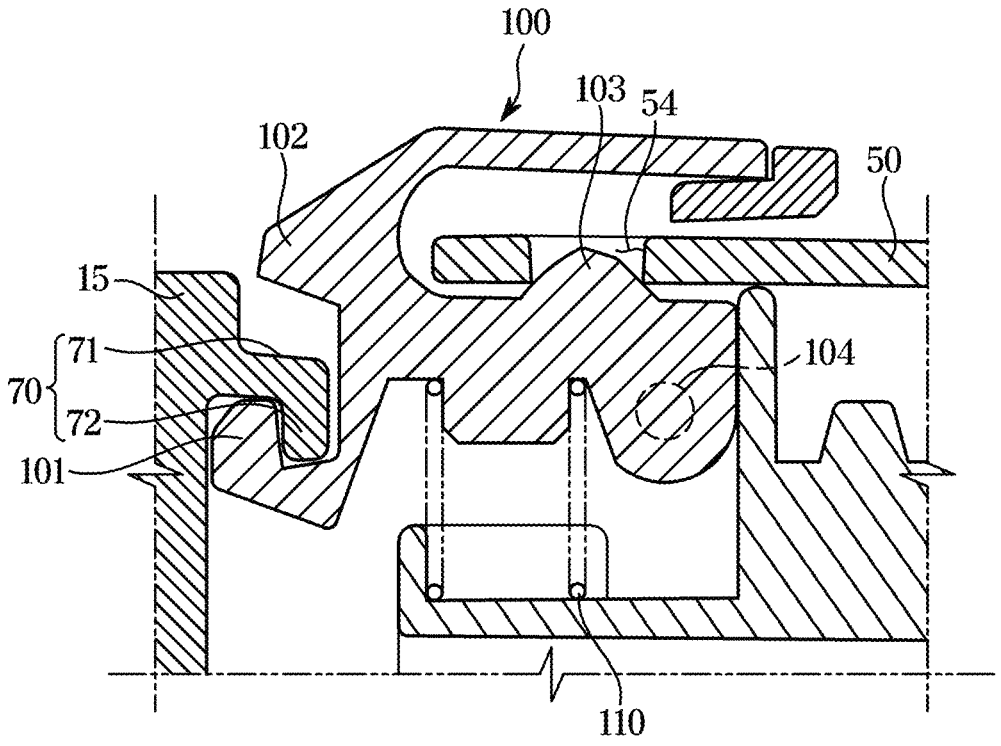
FIGS. 4 and 5 are cross-sectional views taken along line A-A' of FIG. 1, illustrating an operation of a button when a dust collector is separated from a main body.
Figure 5:
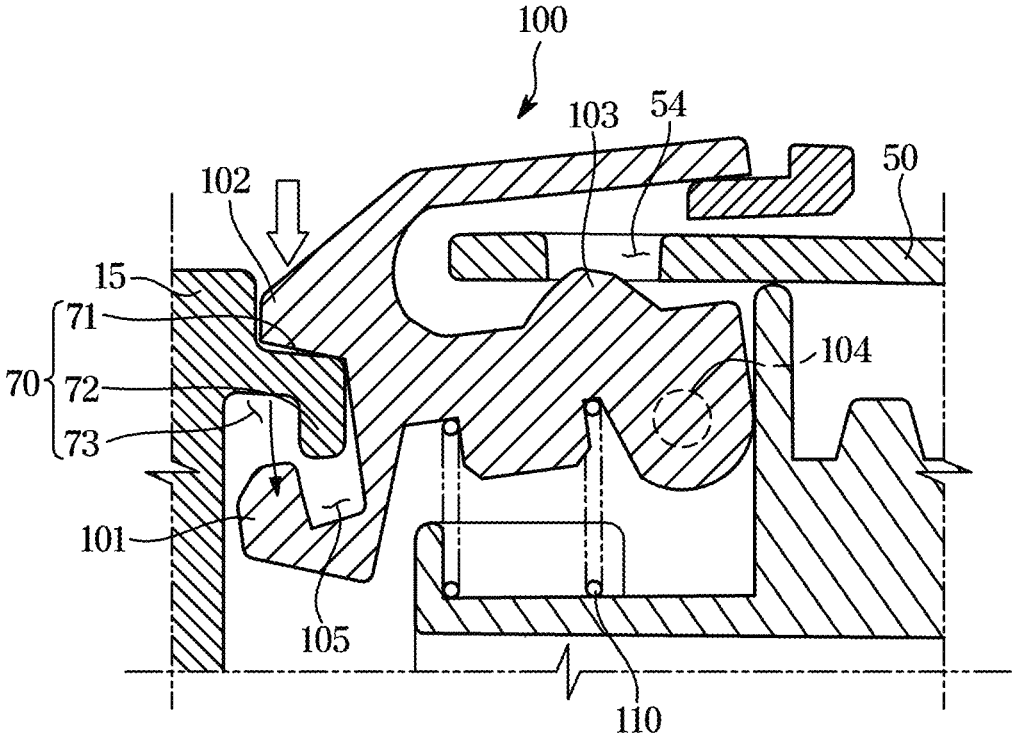

FIGS. 4 and 5 are cross-sectional views taken along line A-A' of FIG. 1, illustrating an operation of the button when the dust collector is separated from the main body.

Hereinafter, the operation of the button 100 will be described in detail with reference to FIGS. 4 and 5. Hereinafter, a first locking portion and a second locking portion may indicate a button coupling portion 70 and a button hole 54, respectively.

Referring to FIGS. 4 and 5, the button 100 may include a first protrusion 101, a second protrusion 102, and a third protrusion 103. The button 100 may be rotatable on a rotation shaft 104. The button 100 may also include a hook groove 105 formed adjacent to the first protrusion 101.

The filter housing 15 may include a button coupling portion 70 (see FIG. 3). The button coupling portion 70 may include a stopper 71 protruding from the filter housing 15 toward the button 100, a hook 72 extending downward from the stopper 71, and a protrusion groove 73 formed between the filter housing 15, the stopper 71 and the hook 72.

The first protrusion 101 may fix or release the dust separator 40 to or from the main body 10. The first protrusion 101 may be inserted into the protrusion groove 73 or taken out of the protrusion groove 73. The first protrusion 101 may be inserted into the protrusion groove 73 to fix the dust separator 40 to the main body 10. The first protrusion 101 may be taken out of the protrusion groove 73 to release the dust separator 40 from the main body 10.

The second protrusion 102 may come into contact with the stopper 71 to restrict a movement range of the button 100. The button 100 may rotate in a first direction. When the button 100 rotates in the first direction, the second protrusion 102 may come into contact with the stopper 71. When the second protrusion 102 is in contact with the stopper 71, the button 100 may be restricted from rotating in the first direction. Thereby, when the dust collectors 40 and 50 are separated from the main body 10, the dust container 50 may be prevented from being separated from the dust separator 40. As will be described later, the dust container 50 may be separated from the dust separator 40 when the dust collectors 40 and 50 are separated from the main body 10.

The third protrusion 103 may be inserted into the button hole 54 provided on the dust container 50. When the third protrusion 103 is inserted into the button hole 54, the dust container 50 may be prevented from being separated from the dust separator 40. As shown in FIG. 5, when the second protrusion 102 comes in contact with the stopper 71, the button 100 may be restricted from rotating. Because the third protrusion 103 is maintained in a state of being inserted into the button hole 54 when the second protrusion 102 is in contact with the stopper 71, the dust container 50 may be not separated from the dust separator 40.

The dust separator 40 may further include an elastic member 110. The elastic member 110 may provide an elastic force to the button 100. The elastic member 110 may provide an elastic force when the button 100 rotates in the first direction so that the button 100 rotates in a second direction that is opposite to the first direction to return to its original position. Thereby, the dust collectors 40 and 50 may be prevented from being separated from the main body 10 due to the first protrusion 101 taken out of the protrusion groove 73 contrary to a user's intention.

Figure 6:
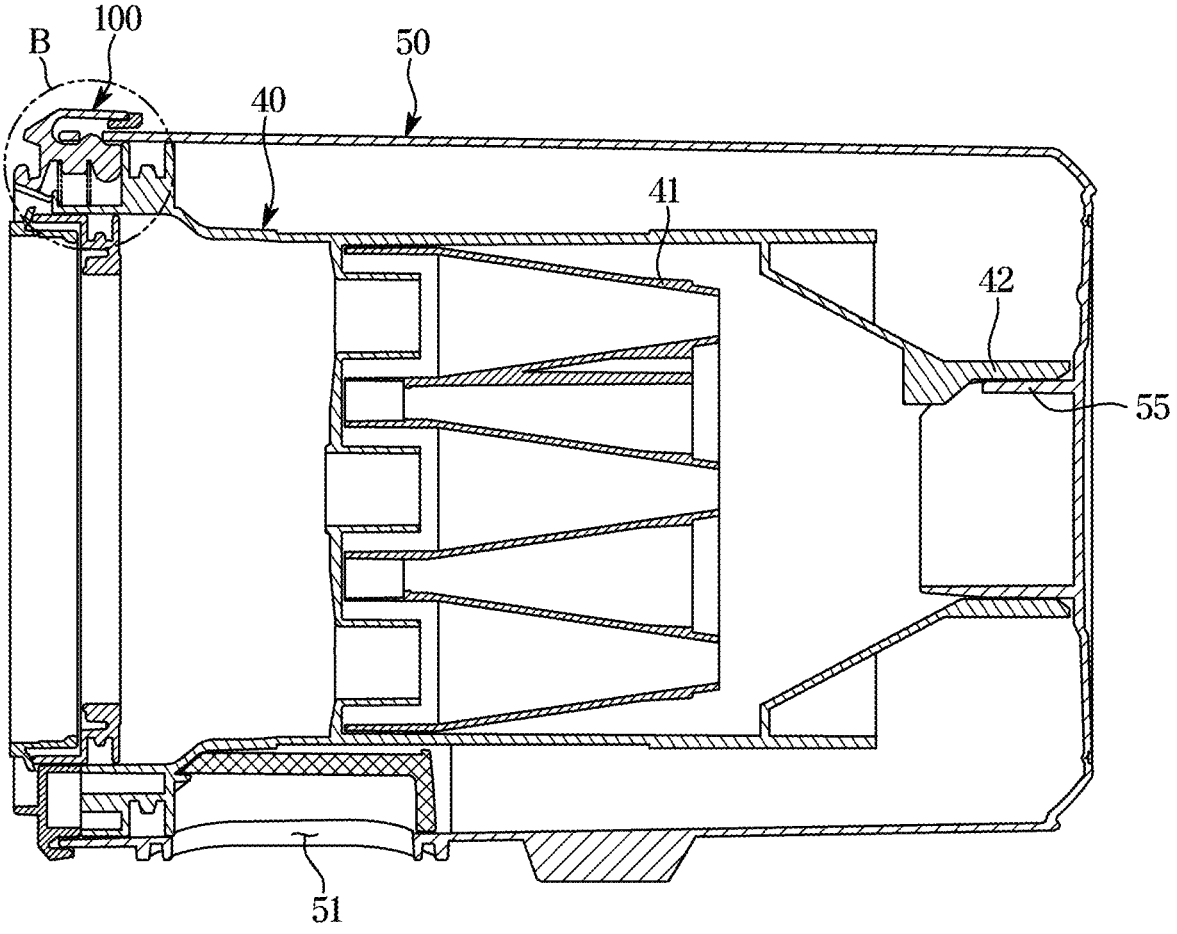
FIG. 6 illustrates a side cross-sectional view of a dust collector in a cleaner according to an embodiment of the disclosure.
Figure 7:
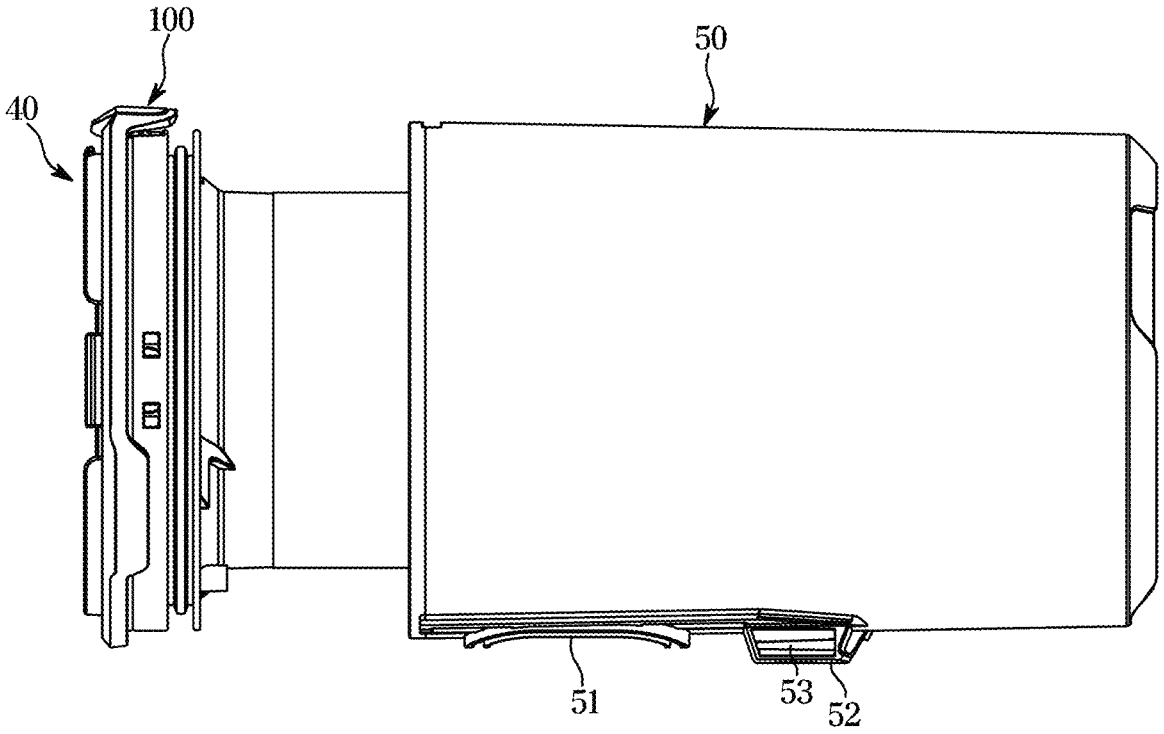
FIG. 7 illustrates a view for describing a process of separating a dust container from a dust separator in a cleaner according to an embodiment of the disclosure.

FIG. 6 illustrates a side cross-sectional view of the dust collector in the cleaner according to an embodiment of the disclosure, and FIG. 7 illustrates a process of separating the dust container from the dust separator in the cleaner according to an embodiment of the disclosure.

Referring to FIGS. 6 and 7, the dust container 50 may be separated from the dust separator 40. Unlike FIGS. 1 to 4, when the dust collectors 40 and 50 are separated from the main body 10, the dust container 50 may be separated from the dust separator 40.

When the dust container 50 is coupled to the dust separator 40 simply by coupling of the third protrusion 103 and the button hole 54, an external force applied to the dust container 50 may separate the dust container 50 from the dust separator 40. To prevent this, the dust container 50 may include a fixing protrusion 55, and the dust separator 40 may include a fixing portion 42. As shown in FIG. 6, the fixing protrusion 55 may be inserted into the fixing portion 42 and the third protrusion 103 may be inserted into the button hole 54, so that the dust container 50 may be stably coupled to the dust separator 40.

The dust container 50 may include the suction port 51 provided on one surface of the dust container 50. The dust separator 40 may include a cyclone portion 41. A plurality of the cyclone portions 41 may be provided.

Air sucked through the suction head 31 may enter the suction port 51 through the extension pipes 32 and 33. When the air entered the suction port 51 passes through the cyclone portion 41, dust contained in the air may be removed, and the air from which dust has been removed may pass through the filter to be discharged to the outside of the main body 10 through the holes 15*a* of the filter housing 15.

Figure 8:
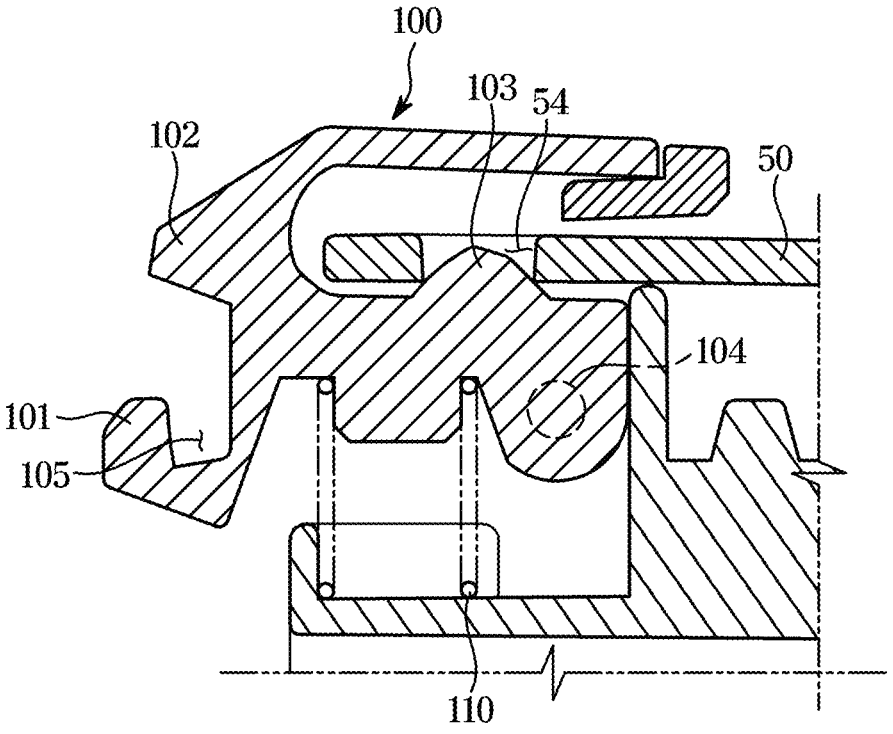
FIGS. 8 and 9 are enlarged views of a portion B of FIG. 6, illustrating an operation of a button when a dust container is separated from a dust separator.
Figure 9:
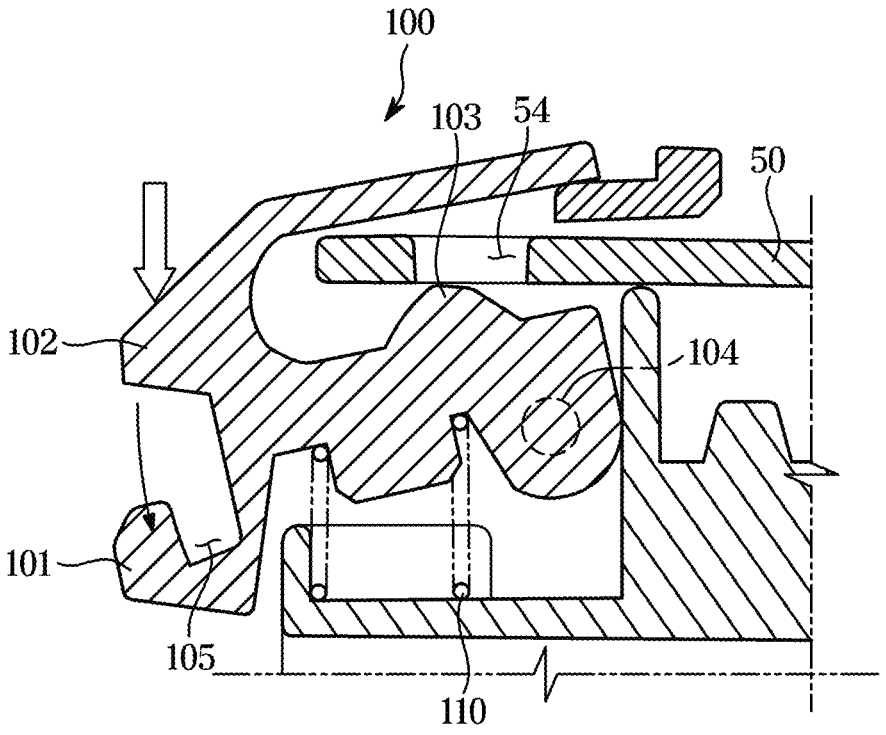

FIGS. 8 and 9 are enlarged views of a portion B of FIG. 6, illustrating an operation of the button when the dust container is separated from the dust separator.

Hereinafter, the operation of the button will be described in detail with reference to FIGS. 8 and 9.

As shown in FIG. 8, even when the dust collectors 40 and 50 are separated from the main body 10, the button 100 may be positioned at a predetermined position by an elastic force of the elastic member 110. The predetermined position is referred to as a first position. The first position is an original position of the button 100 before the button 100 rotates in the first direction.

Referring to FIG. 5, when the dust collectors 40 and 50 are separated from the main body 10, a rotation range of the button 100 may be restricted by the stopper 71. As described above, because the third protrusion 103 is not taken out of the button hole 54 even when the button 100 rotates in the first direction within the restricted rotation range, the dust container 50 may be prevented from being separated from the dust separator 40. A position of the second protrusion 102 at which the second protrusion 102 is in contact with the stopper 71 is referred to as a second position.

Referring to FIG. 9, when the dust collectors 40 and 50 are separated from the main body 10, a rotation range of the button 100 may be not restricted by the stopper 71. Thus, the button 100 may rotate in the first direction from the second position. When the button 100 rotates in the first direction from the second position, the third protrusion 103 may be taken out of the button hole 54. When the third protrusion 103 is taken out of the button hole 54, as shown in FIG. 7, the dust container 50 may be separated from the dust separator 40. As described above, the button 100 may be used not only to separate the dust collectors 40 and 50 from the main body 10 but also to separate the dust container 50 from the dust separator 40. Therefore, two separate operations may be performed by using the button 100, thereby improving ease of use. In addition, utilization of space may be improved compared to a case of providing buttons separately. According to the disclosure, a larger dust storage space may be secured compared to another dust container of the same size. In addition, the dust container 50 may have a smaller size than another dust container of the same dust storage space.

Figure 10:
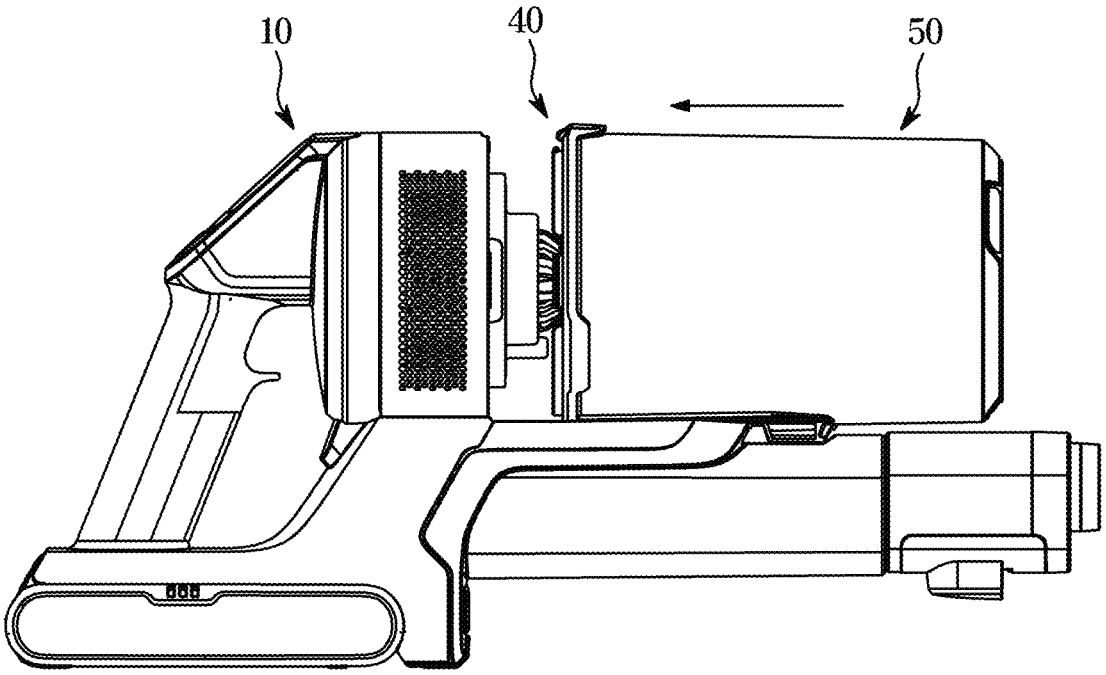
FIGS. 10 to 12 illustrate various methods of coupling a dust collector to a main body in a cleaner according to an embodiment of the disclosure.
Figure 11:
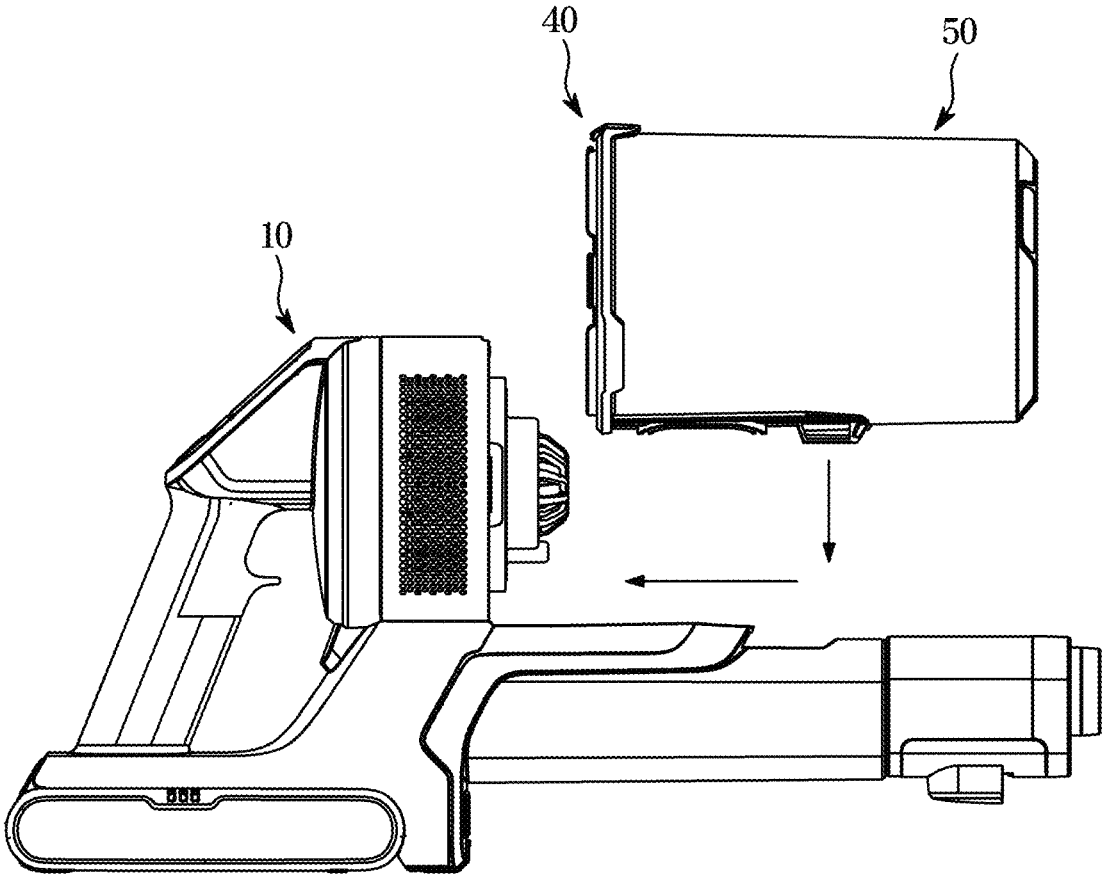
Figure 12:
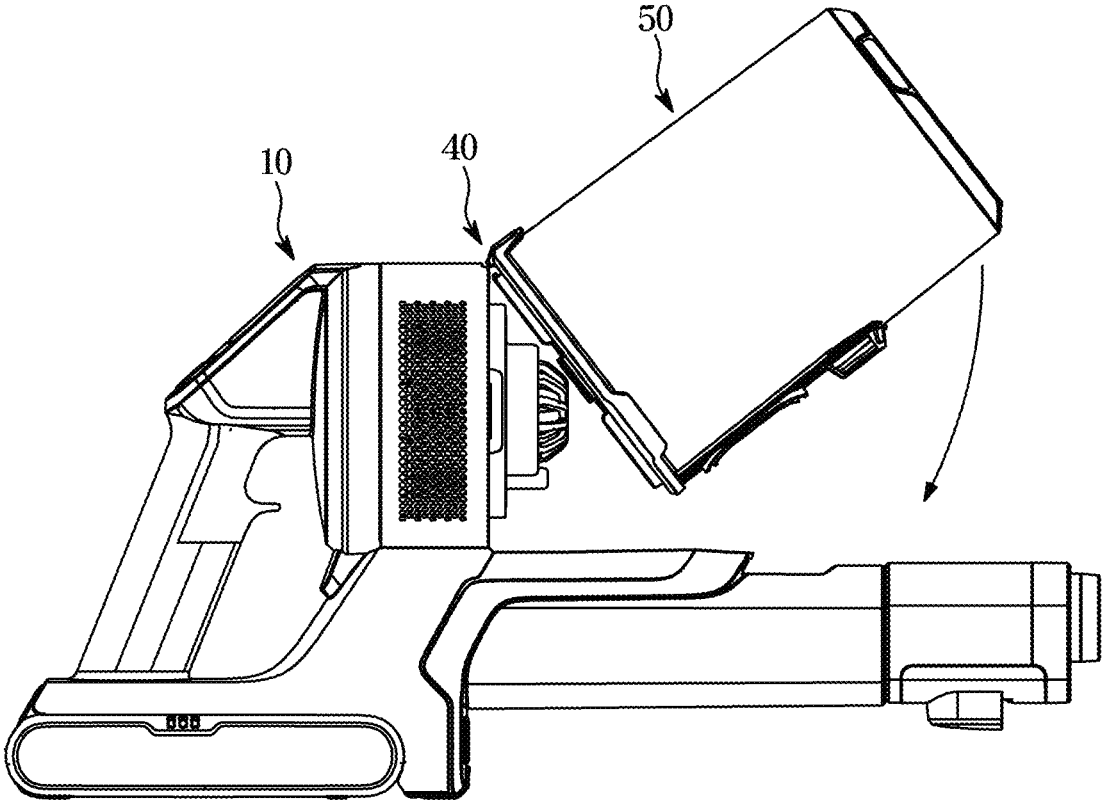

FIGS. 10 to 12 illustrate various methods of coupling the dust collector to the main body in the cleaner according to an embodiment of the disclosure.

According to the disclosure, the dust collectors 40 and 50 may be coupled to the main body 10 by various methods.

As shown in FIG. 10, by aligning a center of the dust collectors 40 and 50 with a center of the filter housing 15 and then causing the dust collectors 40 and 50 to slide in a lateral direction, the dust collectors 40 and 50 may be coupled to the main body 10. The lateral direction may indicate a direction in which the sliding rail 20 extends. When the dust collectors 40 and 50 are coupled to the main body 10 by the method, the sliding protrusion 53 may be inserted into the sliding groove 21 by sliding without being elastically deformed. A description thereof will be given later.

As shown in FIG. 11, by moving the dust collectors 40 and 50 in a downward direction, inserting the sliding protrusion 53 into the sliding groove 21 (refer to FIG. 2) and then causing the dust collectors 40 and 50 to slide in the lateral direction, the dust collectors 40 and 50 may be coupled to the main body 10. The downward direction may indicate a direction intersecting the lateral direction. In this case, the sliding protrusion 53 may be elastically deformed to be inserted into the sliding groove 21. By inserting the sliding protrusion 53 into the sliding groove 21 and causing the dust collectors 40 and 50 to slide in the lateral direction, the dust collectors 40 and 50 may be coupled to the main body 10. A process of inserting the sliding protrusion 53 into the sliding groove 21 will be described later.

As shown in FIG. 12, by rotating the dust collectors 40 and 50, the dust collectors 40 and 50 may be coupled to the main body 10. By after aligning the button 100 with the button coupling portion 70 and then rotating the dust collectors 40 and 50 by using an end of the button 100 as a central axis, the dust collectors 40 and 50 may be coupled to the main body 10. Like FIG. 11, the sliding protrusion 53 may be inserted into the sliding groove 21, and a detailed description thereof will be given later.

As described above, according to the cleaner 1 of the disclosure, the dust collectors 40 and 50 may be coupled to the main body 10 by various methods and in various directions. Accordingly, the user may select a most convenient method according to his/her preference to couple the dust collectors 40 and 50 to the main body 10. By providing various coupling methods, various users' needs may be satisfied, and ease of use of the cleaner 1 may be improved.

Figure 13:
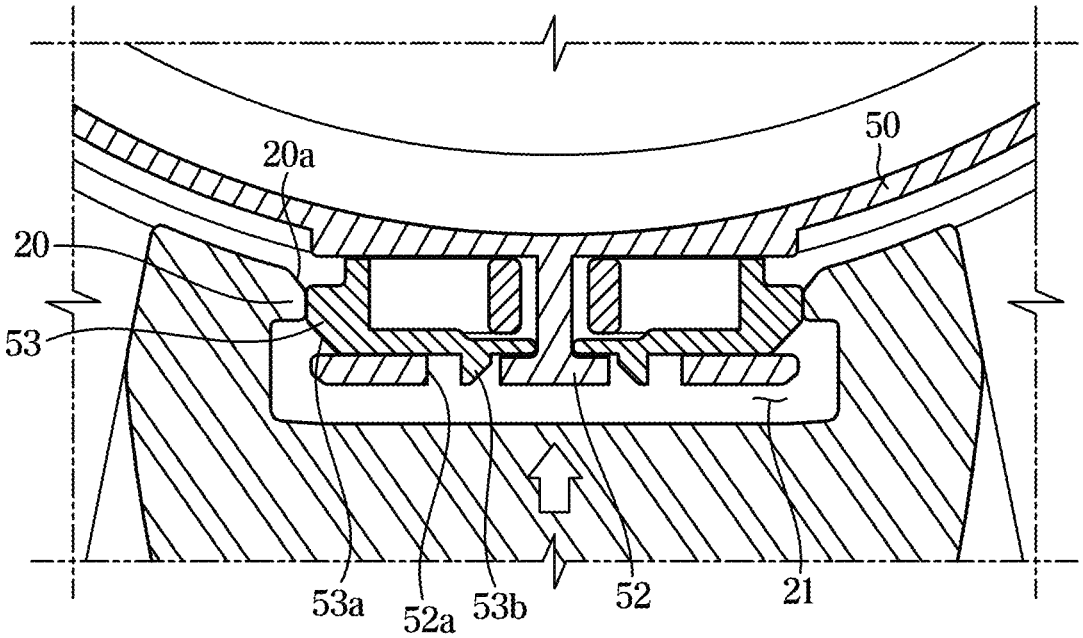
FIGS. 13 and 14 illustrate a process of inserting a sliding protrusion into a sliding groove in a cleaner according to an embodiment of the disclosure.
Figure 14:
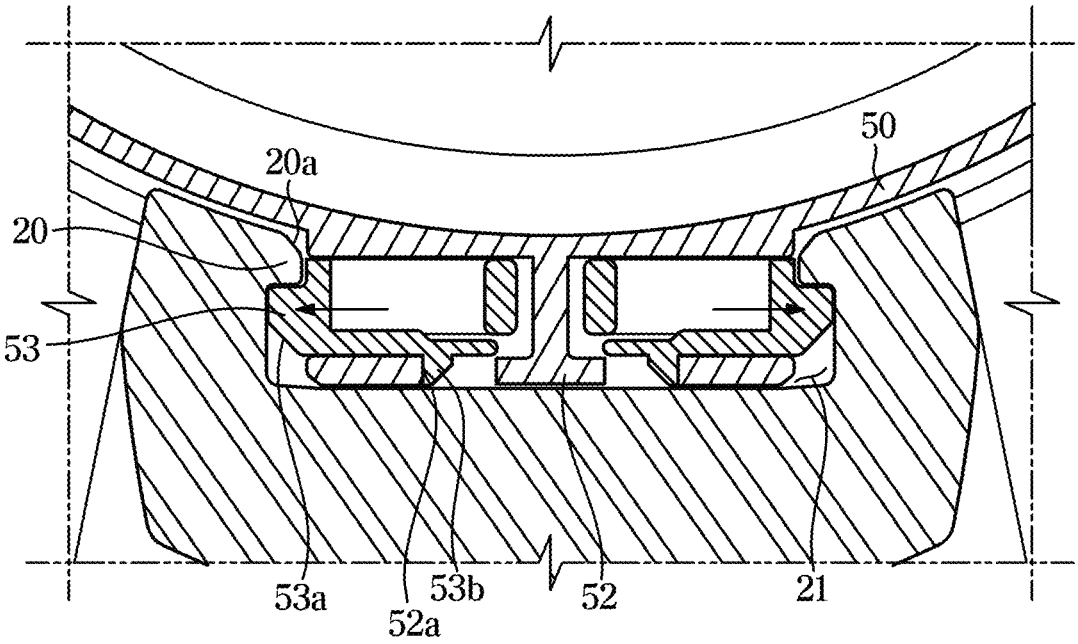

FIGS. 13 and 14 illustrate a process of inserting a sliding protrusion into a sliding groove in the cleaner according to an embodiment of the disclosure.

Hereinafter, a process of inserting the sliding protrusion 53 into the sliding groove 21 in the cleaner 1 according to an embodiment of the disclosure will be described in detail.

The sliding protrusion 53 may be elastically deformable. The sliding protrusion 53 may be received in the protrusion housing 52. Because the sliding protrusion 53 is elastically deformed in the protrusion housing 52, a length of a portion of the sliding protrusion 53 by which the sliding protrusion 53 protrudes to the outside of the protrusion housing 52 may change.

In the following description, a first direction and a second direction may be different from the first direction and the second direction as described above.

The sliding rail 20 may extend in a first direction. A pair of the sliding rails 20 may be provided. A sliding groove 21 may be formed between the sliding rails 20. The sliding groove 21 may extend in the first direction.

The sliding protrusion 53 may slide in the first direction to be inserted into the sliding groove 21. The sliding protrusion 53 may slide without being elastically deformed to be inserted into the sliding groove 21.

The sliding protrusion 53 may be elastically deformed to move in a second direction intersecting the first direction. The second direction may indicate left and right directions in the drawings.

The sliding protrusion 53 may move in a third direction intersecting the first and second directions to be inserted into the sliding groove 21. The third direction may indicate up and down directions in the drawings.

Referring to FIG. 13, when the dust collectors 40 and 50 move in the downward direction, the sliding protrusion 53 may be elastically deformed to move in the second direction. The sliding rail 20 may include a first guide surface 20*a* for guiding the sliding protrusion 53 to move in the second direction. The sliding protrusion 53 may include a second guide surface 53*a* being in contact with the first guide surface 20*a* and guided by the first guide surface 20*a*. When the dust collectors 40 and 50 move in the third direction by the first guide surface 20*a* and the second guide surface 53*a*, the sliding protrusion 53 may move smoothly in the second direction.

Referring to FIG. 14, when the dust collectors 40 and 50 further move in the downward direction, the sliding protrusion 53 may move in a direction that is opposite to the second direction to return to its original position. The sliding protrusion 53 may include a stopper protrusion 53*b* for preventing the sliding protrusion 53 from protruding more than a predetermined distance from the protrusion housing 52. The protrusion housing 52 may include a stopper 52*a* for coming in contact with the stopper protrusion 53*b* to restrict a movement of the sliding protrusion 53. By providing the stopper protrusion 53*b* and the stopper 52*a*, the sliding protrusion 53 may be prevented from protruding from the protrusion housing 52 more than a width of the sliding groove 21. Therefore, the sliding protrusion 53 being not inserted into the sliding groove 21 in the first direction may be prevented.

When the sliding protrusion 53 is inserted into the sliding groove 21, the sliding protrusion 53 may move in the first direction or in the opposite direction of the first direction. When the sliding protrusion 53 is inserted into the sliding groove 21, the sliding protrusion 53 may be restricted from moving in a direction that is opposite to the third direction. In other words, when the sliding protrusion 53 is inserted into the sliding groove 21, the movement of the sliding protrusion 53 in the upward direction may be restricted. This is because there is no guide surface to guide the sliding protrusion 53 when the sliding protrusion 53 moves in the upward direction.

Figure 15:
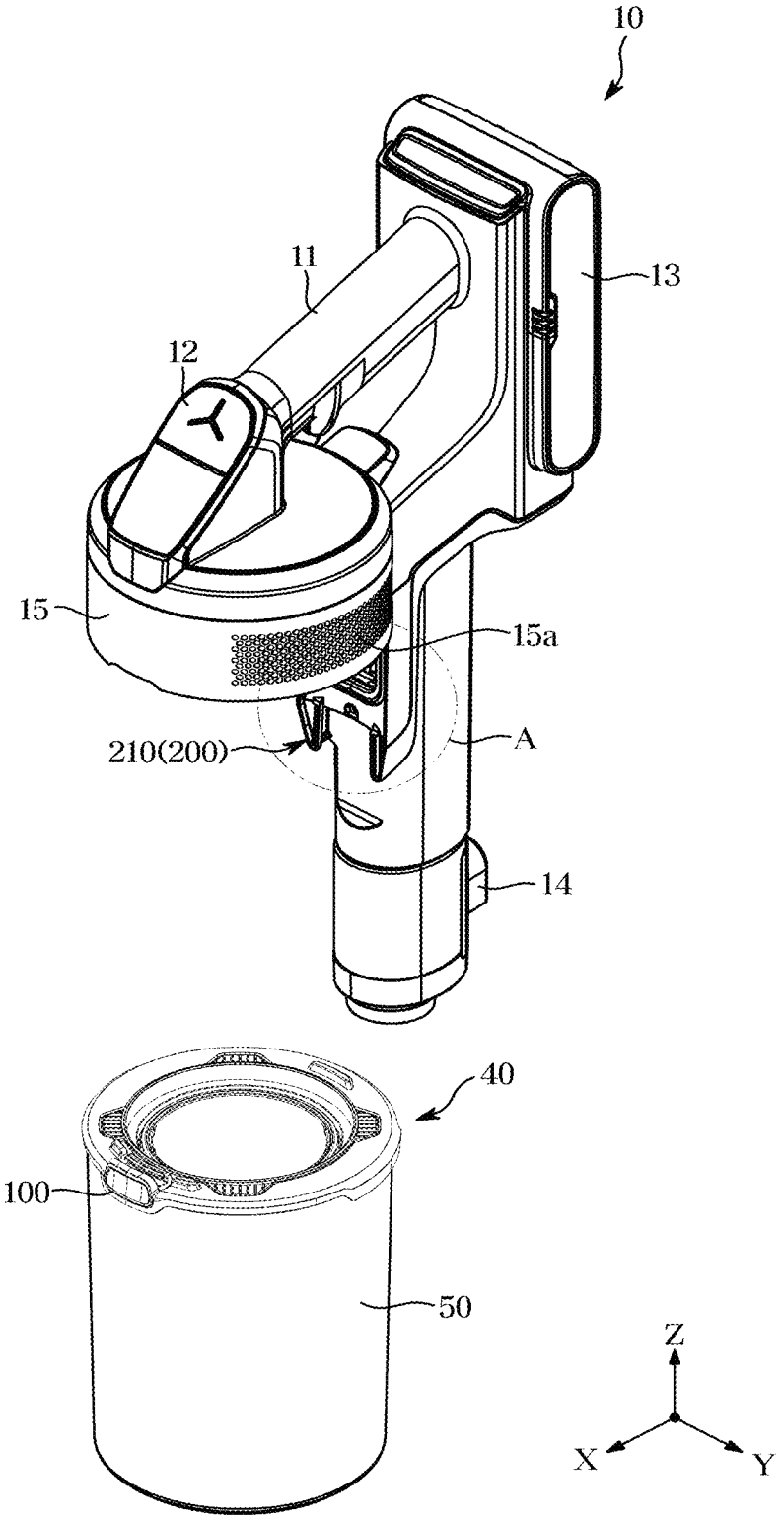
FIG. 15 illustrates a main body and a dust container assembly separated from a main body in a cleaner according to an embodiment of the disclosure.
Figure 16:
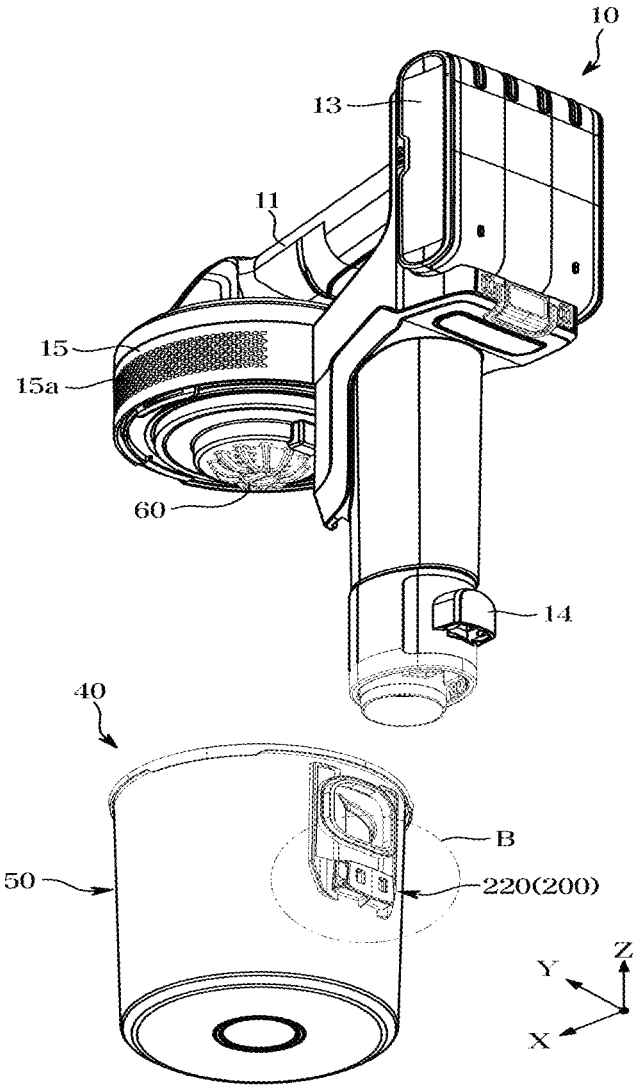
FIG. 16 illustrates the main body and the dust container assembly shown in FIG. 15 at another angle.

FIG. 15 illustrates the main body and the dust container assembly separated from the main body in the cleaner according to an embodiment of the disclosure, and FIG. 16 illustrates the main body and the dust container assembly shown in FIG. 15 at another angle.

As described above, through the sliding protrusion 53 and the sliding groove 21, the dust collectors 40 and 50 may be coupled to the main body 10 by various methods and in various direction, and ease of use of the cleaner 1 may be improved.

According to an embodiment of the disclosure, the cleaner 1 may include a dust container fixer 200. Hereinafter, the dust container assemblies 40 and 50 may indicate the dust separator 40, and the dust container 50 coupled to the dust separator 40. The dust container assemblies 40 and 50 may include the dust separator 40 and the dust container 50.

The dust container fixer 200 may prevent the dust container assemblies 40 and 50 from falling down, which may occur when the dust container assemblies 40 and 50 are separated from the main body 10.

The dust container fixer 200 may include a first fixer 210 provided in the main body 10 and a second fixer 220 provided in the dust container 50. A detailed description of the dust container fixer 200 will be given later.

Figure 17:
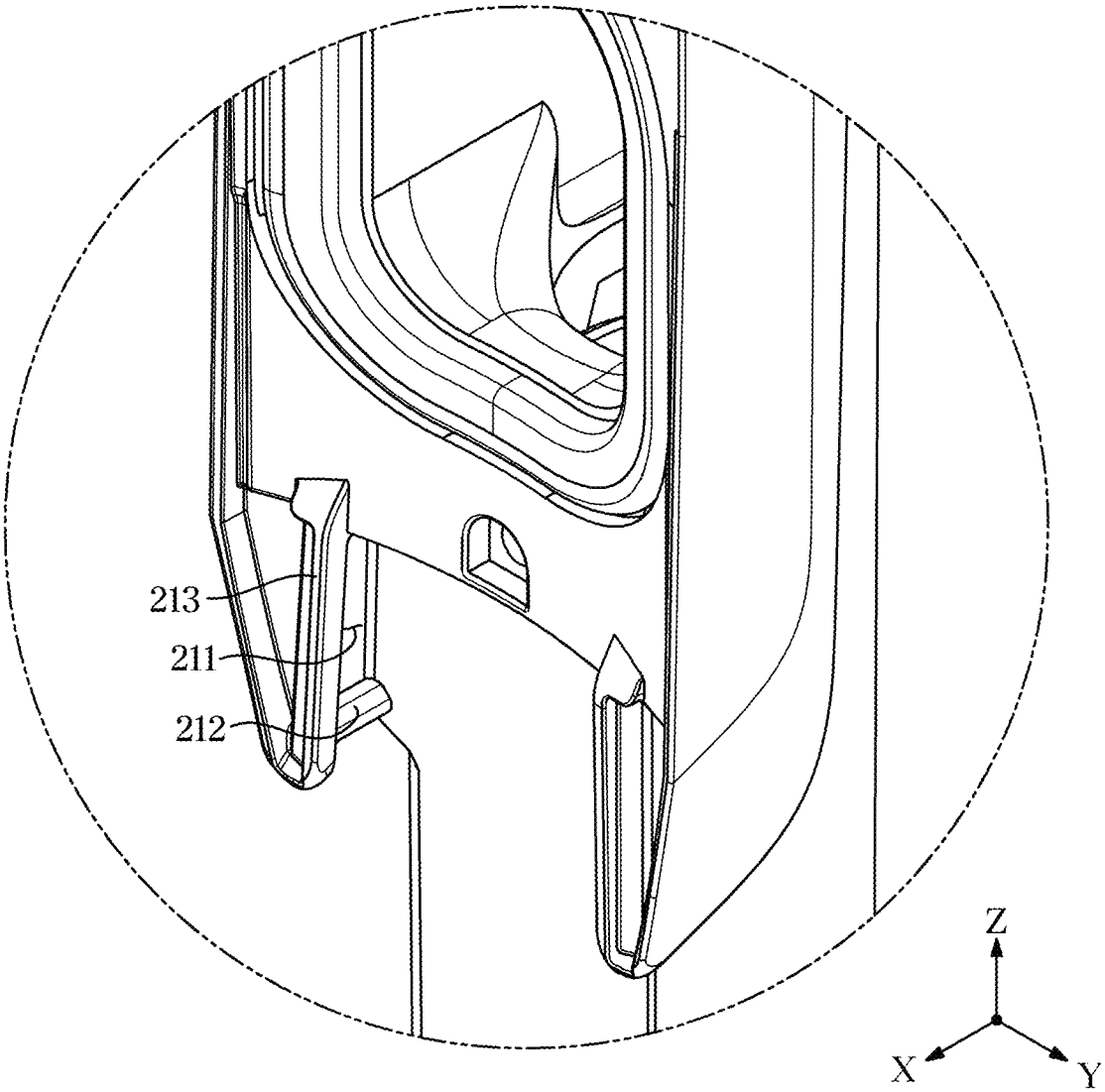
FIG. 17 illustrates an enlarged view of a portion A of FIG. 15.
Figure 18:
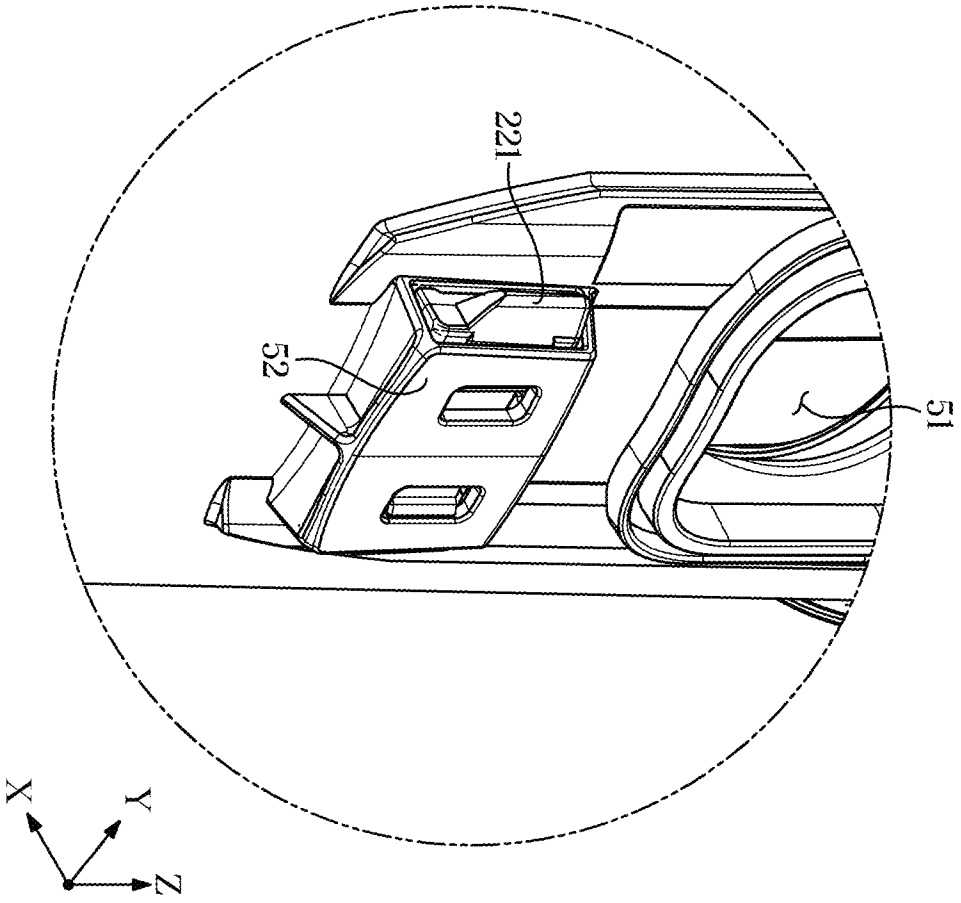
FIG. 18 illustrates an enlarged view of a portion B of FIG. 16.
Figure 19:
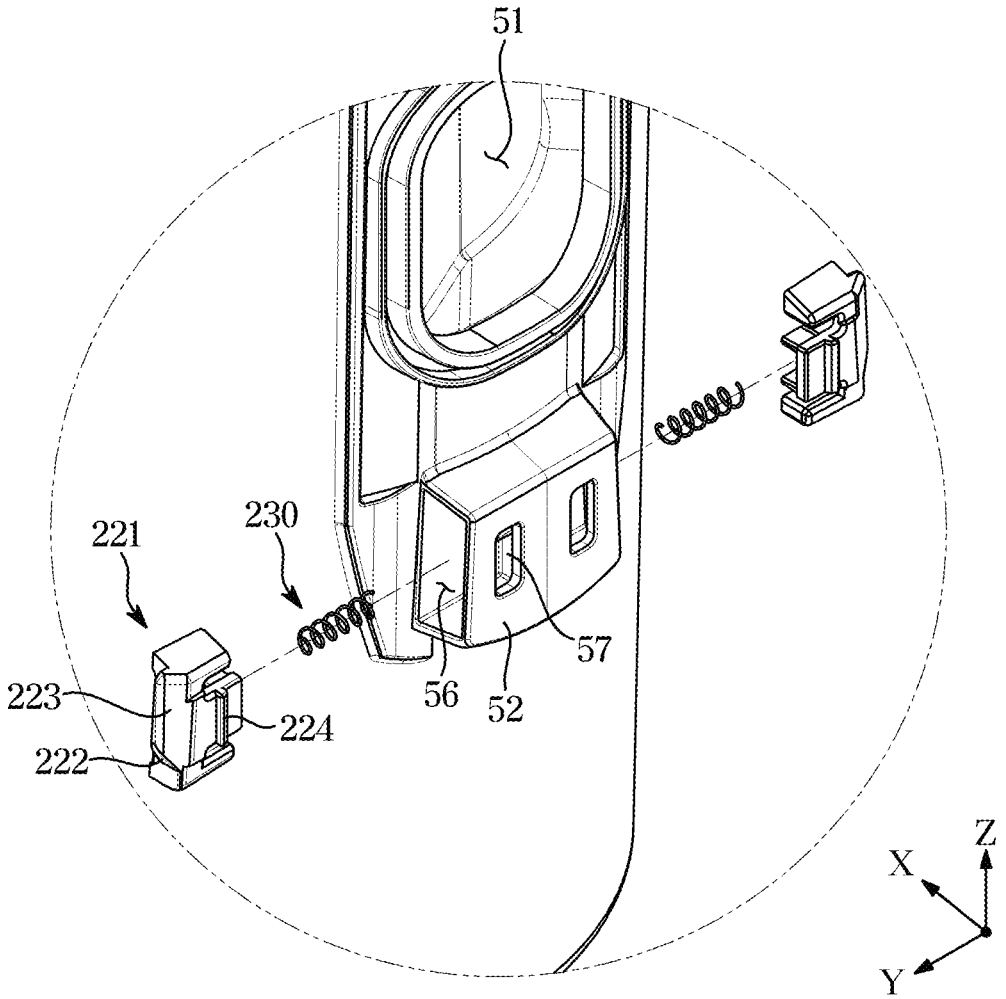
FIG. 19 illustrates a coupling relationship between a dust container, a sliding protrusion, and an elastic member in a cleaner according to an embodiment of the disclosure.

FIG. 17 illustrates an enlarged view of a portion A of FIG. 15, FIG. 18 illustrates an enlarged view of a portion B of FIG. 16, and FIG. 19 illustrates a coupling relationship between the dust container, the sliding protrusion, and an elastic member in the cleaner according to an embodiment of the disclosure.

A configuration of the dust container fixer 200 according to an embodiment of the disclosure will be described below with reference to FIGS. 17 to 19.

Hereinafter, the first direction may indicate a −z axis direction and the second direction may indicate a +y axis direction or a −y axis direction in the drawings.

Referring to FIG. 17, the first fixer 210 may be provided in the main body 10. The first fixer 210 may include a sliding groove 211 extending in the first direction, a latching protrusion 212 provided at one end of the sliding groove 211, and a sliding rail 213 forming the sliding groove 211.

The sliding groove 211 may extend in the first direction in which the extension pipes 32 and 33 extend. A pair of the sliding grooves 211 may be provided. A sliding protrusion 221, which will be described later, may be received in the sliding groove 211.

The latching protrusion 212 may be provided at one end of the sliding groove 211. The latching protrusion 212 may be provided at the end of the sliding groove 211 in the first direction. The latching protrusion 212 may protrude from the sliding groove 211 in the second direction intersecting the first direction.

The sliding rail 213 may be positioned in front of the sliding groove 211 as shown in the drawing. The sliding rail 213 may extend along the first direction. Like the sliding groove 211, a pair of sliding rails 213 may be provided. The sliding rail 213 may prevent the sliding protrusion 221, which will be described later, from being taken out of the sliding groove 211 by moving in the x-axis direction of the drawing.

Referring to FIGS. 18 and 19, the second fixer 220 may include the protrusion housing 52, the sliding protrusion 221 received in the protrusion housing 52, and an elastic member 230 for providing an elastic force to the sliding protrusion 221.

The sliding protrusion 221 may reciprocate in the second direction inside the protrusion housing 52. A pair of the sliding protrusions 221 may be provided, and may move in a direction in which the sliding protrusions 221 approach each other or in a direction in which the sliding protrusion 221 are spaced away from each other. The elastic member 230 may provide an elastic force to move the pair of sliding protrusions 221 in the direction in which the sliding protrusions 221 are spaced away from each other.

The protrusion housing 52 may include a first opening 56 and a second opening 57. The sliding protrusion 221 may be inserted into the protrusion housing 52 through the first opening 56. A size of the sliding protrusion 221 may be larger than that of the first opening 56. Accordingly, the sliding protrusion 221 may be elastically deformed when the sliding protrusion 221 is inserted into the protrusion housing 52 through the first opening 56.

When the sliding protrusion 221 is inserted into the protrusion housing 52, a stopper 224 of the sliding protrusion 221 may be taken out through the second opening 57 of the protrusion housing 52. The stopper 224 may be movable in the second opening 57. A movement distance of the sliding protrusion 221 inside the protrusion housing 52 may be restricted by the stopper 224. Due to the stopper 224, the sliding protrusion 221 may not be taken out to the outside of the protrusion housing 52 through the first opening 56.

The sliding protrusion 221 may include an inclined surface. More specifically, the sliding protrusion 221 may include a first guide surface 222 inclined with respect to the first direction, and a second guide surface 223 inclined with respect to the third direction. In this case, the first direction indicates the −z axis direction in the drawing, and the third direction indicates a −x axis direction in the drawing.

Because the sliding protrusion 221 includes the first guide surface 222, the sliding protrusion 221 may pass through the latching protrusion 212 in the first direction.

Because the sliding protrusion 221 includes the second guide surface 223, the sliding protrusion 221 may be inserted into the sliding groove 211 in the third direction. In other words, because the sliding protrusion 221 includes the second guide surface 223, the sliding protrusion 221 may pass through the sliding rail 213 in the −x axis direction.

Figure 20:
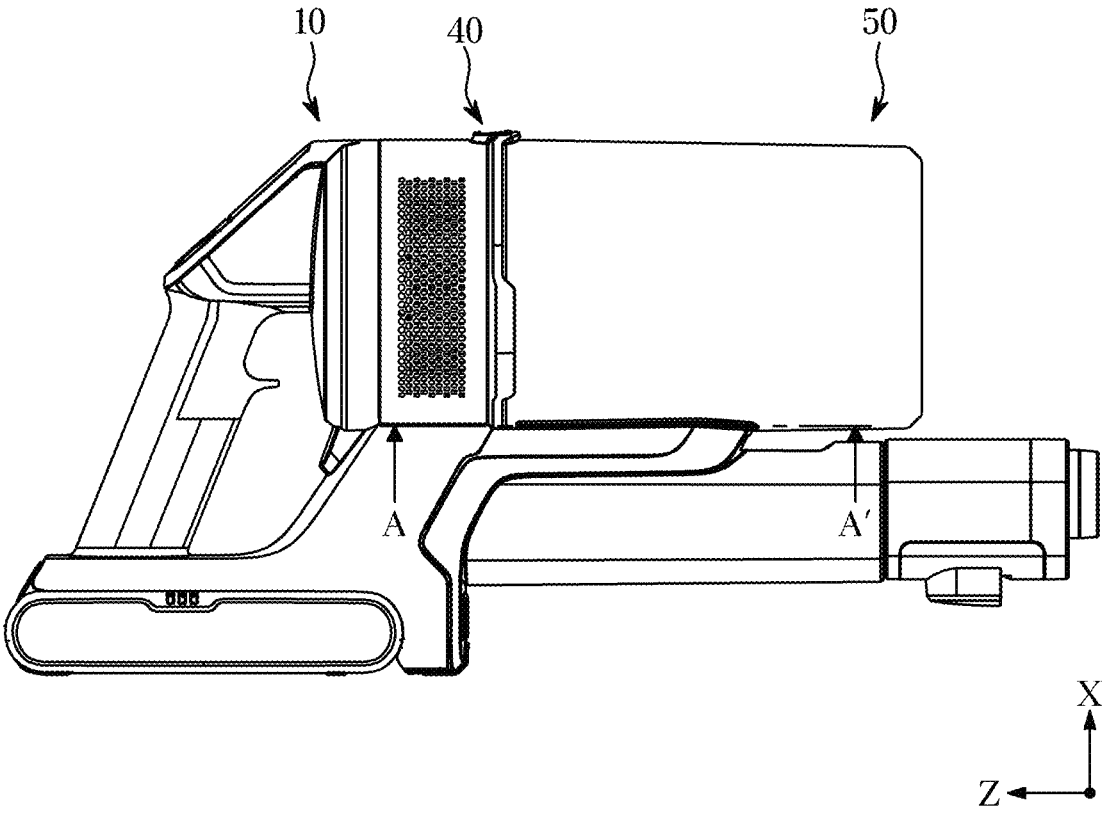
FIG. 20 illustrates a side view of a cleaner according to an embodiment of the disclosure.
Figure 21:
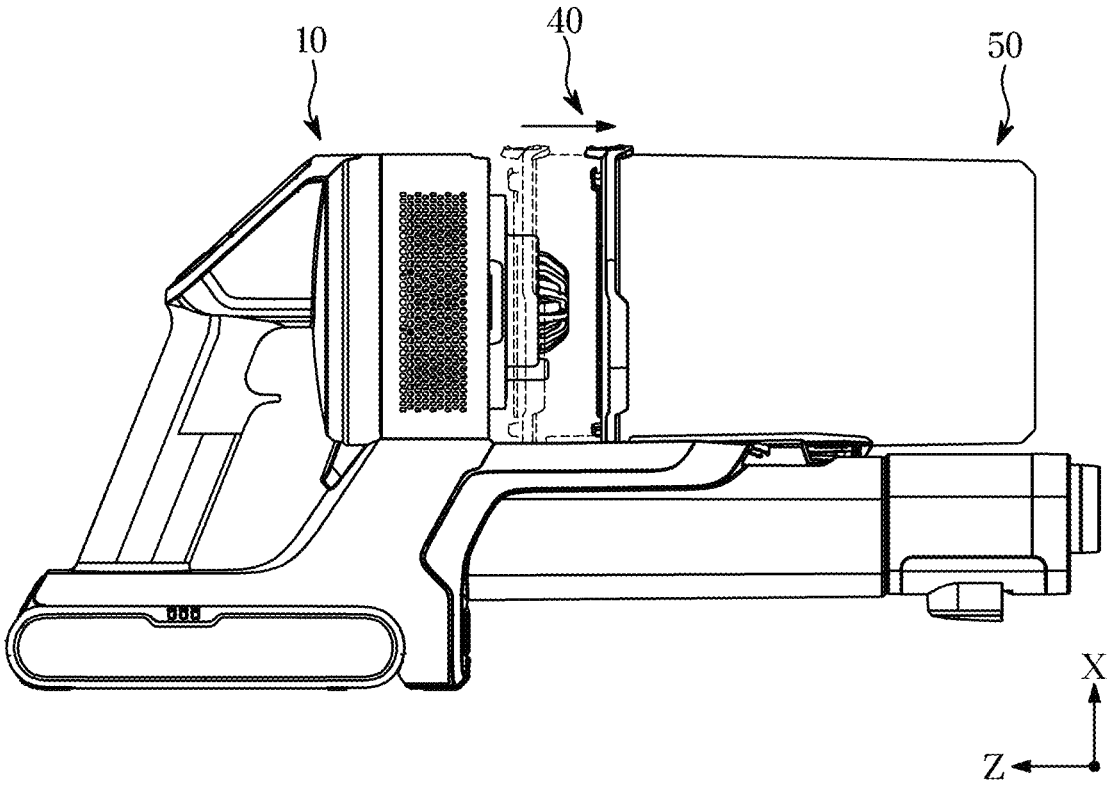
FIG. 21 is a side view of a cleaner according to an embodiment of the disclosure, illustrating a process of separating a dust container from a main body.

FIG. 20 illustrates a side view of the cleaner according to an embodiment of the disclosure, and FIG. 21 illustrates a side view of the cleaner according to an embodiment of the disclosure, showing a process of separating the dust container from the main body.

Referring to FIGS. 20 and 21, in the cleaner 1 according to an embodiment of the disclosure, when the dust container assemblies 40 and 50 are separated from the main body 10, the dust container assemblies 40 and 50 may not be immediately separated from the main body 10 by the dust container fixer 200.

Referring to FIG. 21, the dust container assemblies 40 and 50 may not be immediately separated from the main body 10 even when a user presses the button 100 to release the dust container assemblies 40 and 50 from the main body 10. More specifically, the dust container assemblies 40 and 50 may be prevented from moving by their own weights in the −z axis direction due to the sliding protrusion 221 caught by the latching protrusion 212. The user may completely separate the dust container assemblies 40 and 50 from the main body 10 by applying a greater force than the weights of the dust container assemblies 40 and 50 in the −z axis direction.

Figure 22:
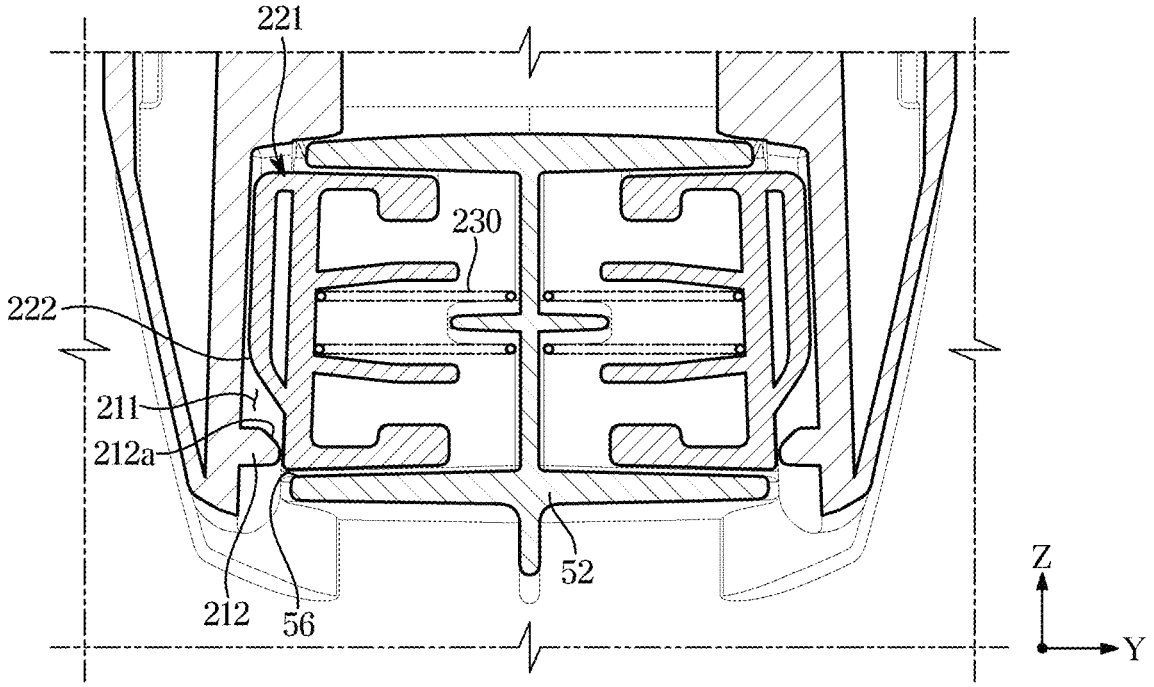
FIG. 22 is a cross-sectional view taken along line A-A' of FIG. 20, illustrating a state of a coupling device when a dust container is coupled to a main body.
Figure 23:
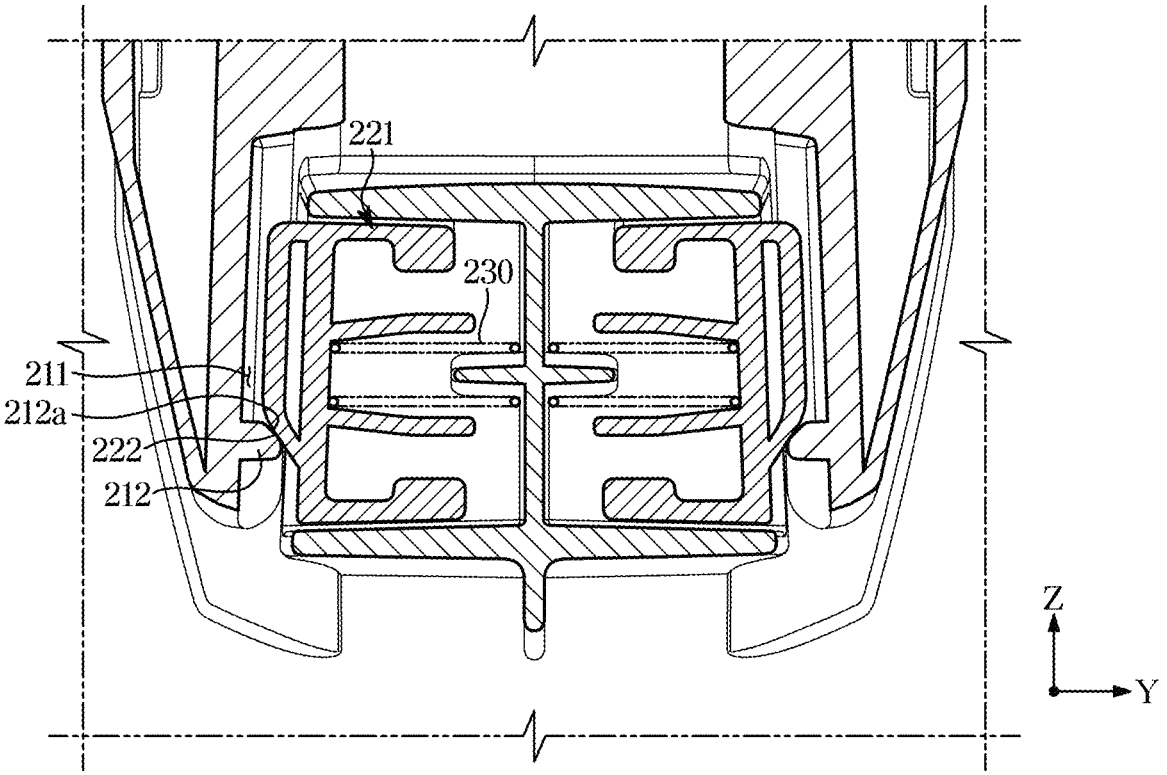
FIG. 23 is a cross-sectional view taken along line A-A' of FIG. 20, illustrating a state in which a sliding protrusion is caught by a latching protrusion when a dust container is decoupled from a main body.
Figure 24:
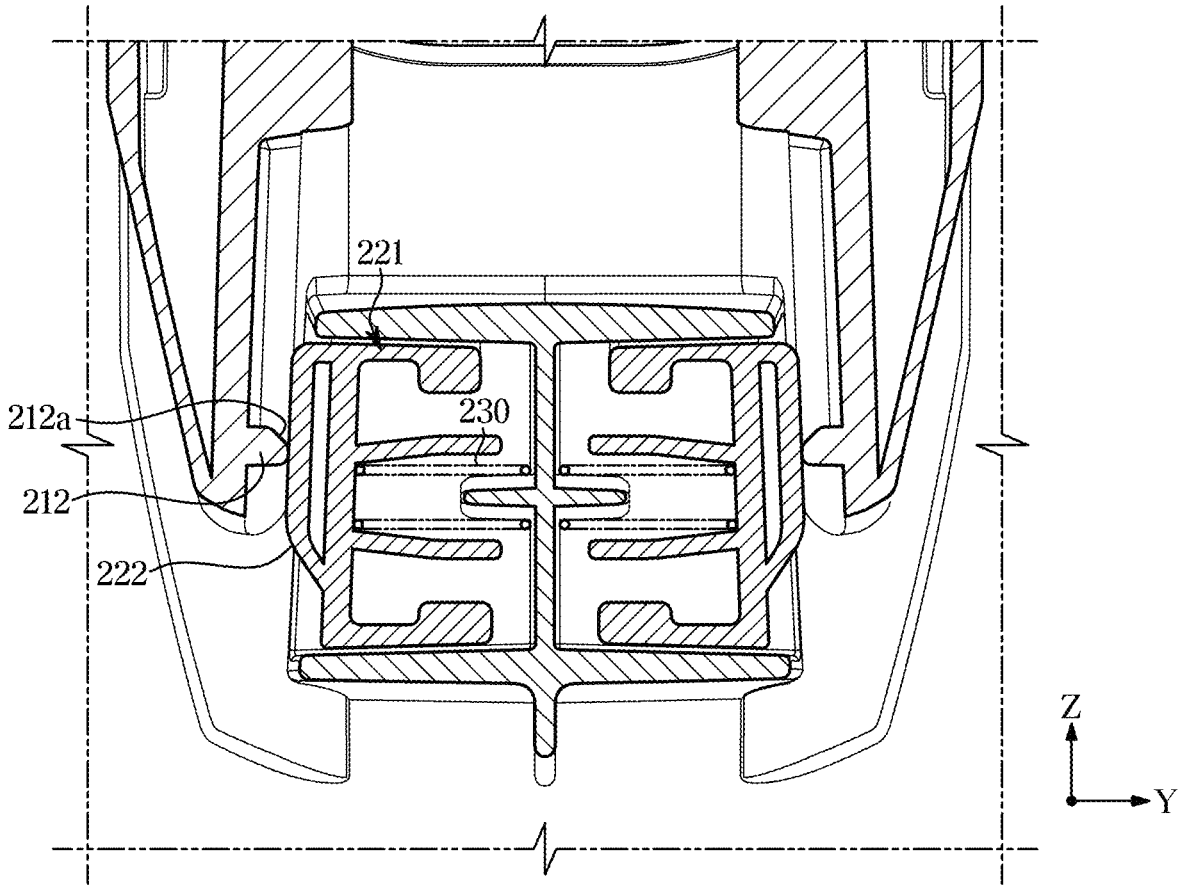
FIG. 24 is a cross-sectional view taken along line A-A' of FIG. 20, illustrating a process in which a sliding protrusion passes through a latching protrusion.

FIG. 22 is a cross-sectional view taken along line A-A' of FIG. 20, illustrating a state of a coupling device when the dust container is coupled to the main body, FIG. 23 is a cross-sectional view taken along the line A-A' of FIG. 20, illustrating a state in which the sliding protrusion is caught by the latching protrusion when the dust container is released from the main body, and FIG. 24 is a cross-sectional view taken along line A-A' of FIG. 20, illustrating a process in which the sliding protrusion passes through the latching protrusion.

A process in which the sliding protrusion 221 according to an embodiment of the disclosure passes through the latching protrusion 212 will be described in detail below with reference to FIGS. 22 to 24.

Referring to FIG. 22, when the dust container assemblies 40 and 50 are coupled to the main body 10, the sliding protrusion 221 may be received in the sliding groove 211. The sliding protrusion 221 may be spaced apart from the latching protrusion 212 so as not to be in contact with the latching protrusion 212. The sliding protrusion 221 may be spaced by a predetermined distance in the +z axis direction from the latching protrusion 212.

The elastic member 230 may provide the elastic force to the pair of sliding protrusions 221 such that the sliding protrusions 221 are spaced away from each other. A distance between the pair of sliding protrusions 221 may become increased. The sliding protrusion 221 may be in contact with a side surface of the sliding groove 211.

Referring to FIG. 23, even when the user presses the button 100 to release the dust container assemblies 40 and 50 from the main body 10, the dust container assemblies 40 and 50 may be not separated from the main body 10 by the sliding protrusion 221 caught by the latching protrusion 212.

The sliding protrusion 221 may be in contact with the latching protrusion 212. More specifically, the first guide surface 222 of the sliding protrusion 221 may be in contact with a third guide surface **212*a* of the latching protrusion 212. When the first guide surface 222 slides along the third guide surface 212*a* by the weight of the dust container 50, each of the pair of sliding protrusions 221 may move in the +y axis direction or the −y axis direction. Accordingly, the distance between the pair of sliding protrusions 221 may be shorter than that shown in FIG. 22**.

As shown in FIG. 24, when the user applies a greater force than the weight of the dust container assemblies 40 and 50 in the −z axis direction to separate the dust container assemblies 40 and 50 from the main body 10, the sliding protrusion 221 may pass through the latching protrusion 212. By the force applied by the user, the pair of sliding protrusion 221 may move in the +y axis or the −y axis direction despite the elastic force of the elastic member 230. The distance between the pair of sliding protrusions 221 may be reduced.

A side surface of the sliding protrusion 221 may be in contact with the latching protrusion 212. The sliding protrusion 221 may slide while being in contact with the latching protrusion 212. When the sliding protrusion 221 passes through the latching protrusion 212, the dust container assemblies 40 and 50 may be completely separated from the main body 10.

As described above, the cleaner 1 according to the disclosure may include the dust container fixer 200. The dust container fixer 200 may prevent the dust container assemblies 40 and 50 from immediately falling to a floor even when the user presses the button 100 accidentally. The dust container assemblies 40 and 50 may be first maintained in a state of being coupled to the main body 10 by the dust container fixer 200, and may be completely detached from the main body 10 when the user applies a predetermined force to the dust container assemblies 40 and 50 to separate the dust container assemblies 40 and 50 from the main body 10. Thereby, the dust container assemblies 40 and 50 in the cleaner 1 according to the disclosure may be prevented from falling down contrary to the user's intention. Therefore, a hassle to again perform cleaning due to dust scattered when the dust container assemblies 40 and 50 fall down may be reduced.

Figure 25:
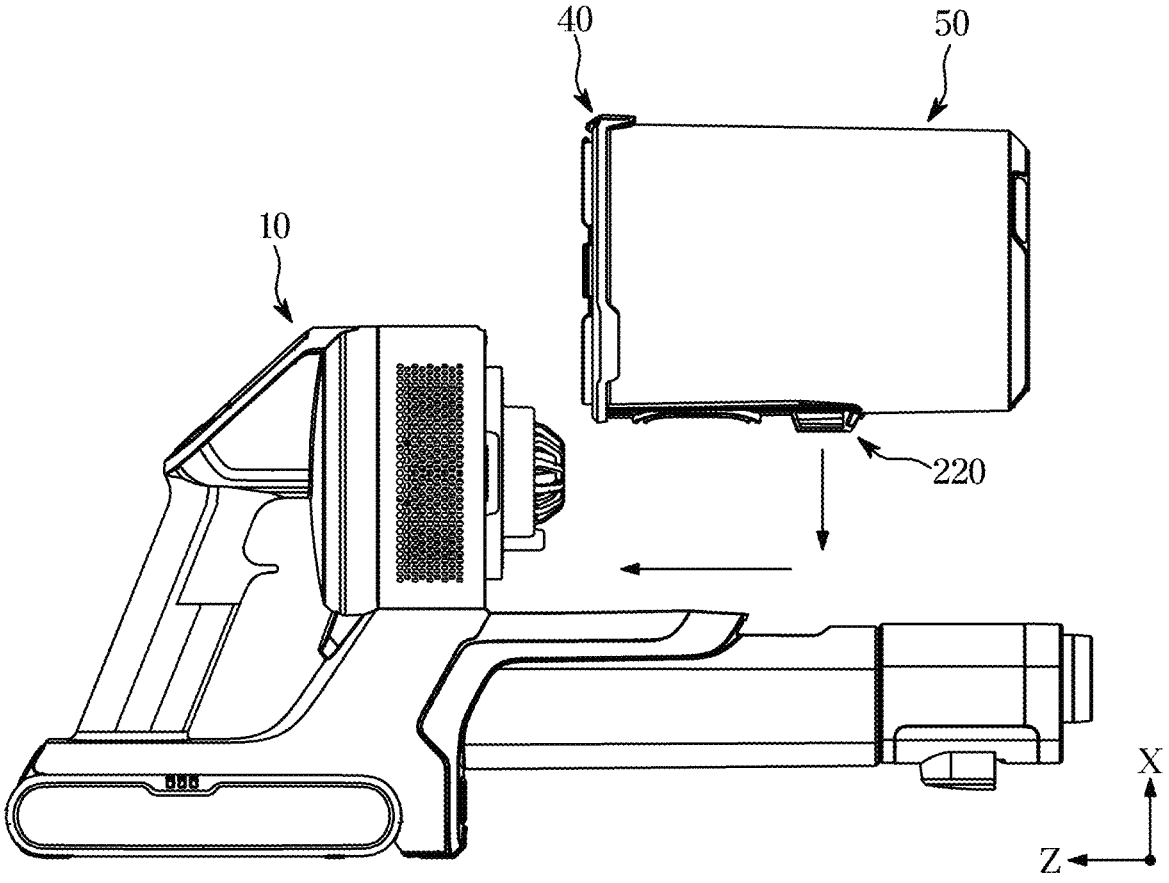
FIGS. 25 and 26 illustrate various methods of coupling a dust container assembly to a main body in a cleaner according to an embodiment of the disclosure.
Figure 26:
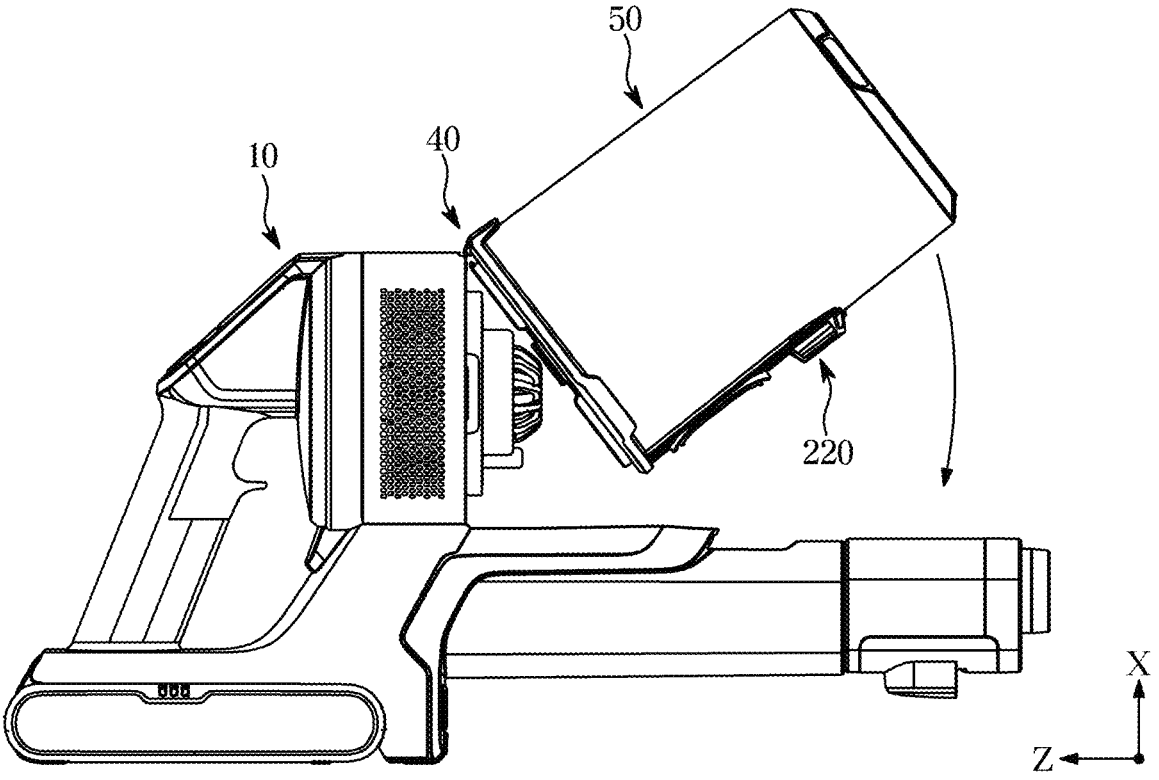

FIGS. 25 and 26 illustrate various methods of coupling the dust container assembly to the main body in the cleaner according to an embodiment of the disclosure.

According to the disclosure, the dust container 50 may be coupled to the main body 10 by various methods.

As shown in FIG. 26, by aligning the center of the dust container assemblies 40 and 50 with the center of the filter housing 15 and making the dust container assemblies 40 and 50 slide in the +z axis direction, the dust container assemblies 40 and 50 may be coupled to the main body 10. When the dust container assemblies 40 and 50 are coupled to the main body 10 in this method, the sliding protrusion 221 may not move in the y axis direction. The sliding protrusion 221 may be inserted into the sliding groove 211 by sliding in the +z axis direction along the sliding groove 211.

As shown in FIG. 26, the sliding protrusion 221 may be inserted into the sliding groove 211 by positioning the button 100 to correspond to the button coupling portion provided in the main body 10 and rotating the dust container assemblies 40 and 50. A process in which the sliding protrusion 221 passes through the sliding rail 213 and is inserted into the sliding groove 211 will be described later.

According to the cleaner 1 of the disclosure, the dust container assemblies 40 and 50 may be coupled to the main body 10 by various methods and in various directions. Accordingly, the user may select a most convenient method according to his/her preference to couple the dust container assemblies 40 and 50 to the main body 10. By providing various coupling methods, various users' needs may be satisfied, and ease of use of the cleaner 1 may be improved.

Figure 27:
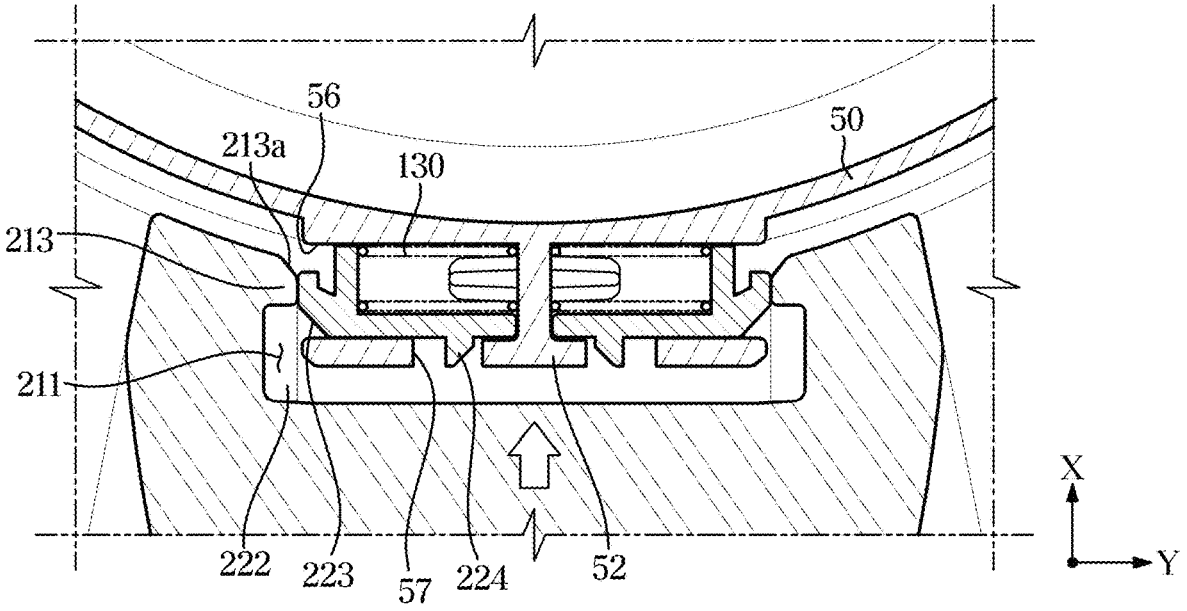
FIGS. 27 and 28 illustrate a process of inserting a sliding protrusion into a sliding groove in a cleaner according to an embodiment of the disclosure.
Figure 28:
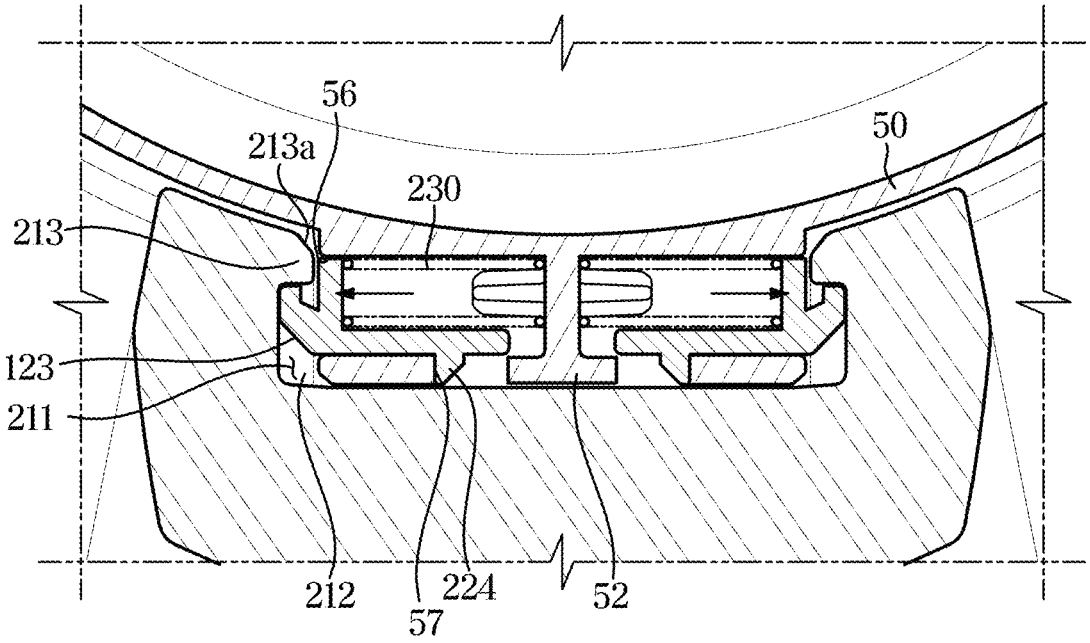

FIGS. 27 and 28 are views illustrating a process of inserting the sliding protrusion into the sliding groove in the cleaner according to an embodiment of the disclosure.

Hereinafter, a process in which the sliding protrusion 221 passes through the sliding rail 213 and is inserted into the sliding groove 211 in the cleaner 1 according to an embodiment of the disclosure will be described in detail.

As described above, the sliding protrusion 221 may move in the +y axis or −y axis direction when a greater force than the elastic force of the elastic member 230 is applied. When the pair of sliding protrusions 221 move in a direction in which the sliding protrusions 221 approach each other, the pair of sliding protrusions 221 may pass through the sliding rail 213 in the −x axis direction. The −x axis direction is referred to as the third direction.

Referring to FIG. 27, the sliding protrusion 221 may include the second guide surface 223 inclined with respect to the third direction. The sliding protrusion 221 may include the second guide surface 223 inclined with respect to the third direction in addition to the first guide surface 222 inclined with respect to the first direction.

When the sliding protrusion 221 moves in the third direction, the second guide surface 223 may come into contact with the sliding rail 213. The sliding rail 213 may include a fourth guide surface 213*a* to guide the sliding protrusion 221 to pass through the sliding rail 213 in the third direction.

The second guide surface 223 of the sliding protrusion 221 may be guided by the fourth guide surface 213*a* of the sliding rail 213. Thereby, the sliding protrusion 221 may move in the −x axis direction, and simultaneously move in the +y axis direction or the −y axis direction. Therefore, as shown in FIG. 14, the distance between the pair of sliding protrusions 221 may be reduced when the sliding protrusions 221 move in the −x axis direction.

Referring to FIG. 28, the sliding protrusion 221 that has passed through the sliding rail 213 may be inserted into the sliding groove 211. After passing through the sliding rail 213, the pair of sliding protrusions 121 may move to be spaced away from each other by the elastic force of the elastic member 230.

When the sliding protrusion 221 is inserted into the sliding groove 211, the dust container assemblies 40 and 50 may be prevented from being separated from the main body 10 in the +x axis direction. The reason is because the sliding protrusion 221 is incapable of being taken out of the sliding groove 211 in the +x axis direction. A lower surface of the sliding rail 213 in the drawing may not be inclined. An upper surface of the sliding protrusion 221 in the drawing may not be inclined. Accordingly, the upper surface of the sliding protrusion 221 and the lower surface of the sliding rail 213 may form a substantially horizontal contact surface. In this case, even when the user applies a force to the dust container assemblies 40 and 50 in the +x axis direction, the sliding protrusion 221 may not move in the +y axis direction or the −y axis direction, and the dust container assemblies 40 and 50 may not be separated from the main body 10. Thereby, the dust container assemblies 40 and 50 may be prevented from being separated from the main body 10 contrary to a user's intention when the user does not press the button 100.

As is apparent from the above, according to a concept of the disclosure, there may be provided a cleaner capable of separating a dust separator from a main body and separating a dust container from the dust separator by using a button.

According to another concept of the disclosure, there may be provided a cleaner capable of preventing a dust container from being separated from a dust separator when a dust collector is separated from a main body.

According to another concept of the disclosure, there may be provided a cleaner capable of coupling a dust collector to a main body in various directions.

According to another concept of the disclosure, there may be provided a cleaner capable of preventing a dust container from falling down due to a user's carelessness when the dust container is separated.

According to another concept of the disclosure, there may be provided a cleaner including a dust container fixer capable of preventing a dust container from falling down when the dust container is decoupled from a main body.

Although the present disclosure has been described with various embodiments, various changes and modifications may be suggested to one skilled in the art. It is intended that the present disclosure encompass such changes and modifications as fall within the scope of the appended claims.

What is claimed is:

1. A cleaner comprising:

a main body;

a dust separator detachably coupled to the main body, the dust separator configured to separate dust contained in air;

a dust container detachably coupled to the dust separator; and a button configured to:

separate the dust separator from the main body, and separate the dust container from the dust separator based on the dust separator being separated from the main body.

2. The cleaner according to claim 1, wherein the button comprises:

a first protrusion configured to fix or release the dust separator to or from the main body; and a second protrusion configured to fix or release the dust container to or from the dust separator.

3. The cleaner according to claim 2, wherein:

the main body comprises a first locking portion in which the first protrusion is inserted into or taken out of, and the dust container comprises a second locking portion in which the second protrusion is inserted into or taken out of.

4. The cleaner according to claim 3, wherein the button further comprises a third protrusion configured to restrict a movement range of the button by contacting a stopper provided in the main body.

5. The cleaner according to claim 4, wherein the third protrusion is further configured to restrict the movement range of the button such that the second protrusion is not taken out of the second locking portion based on the dust separator being separated from the main body.

6. The cleaner according to claim 3, wherein the button is further configured to be rotatable in a first direction such that:

the first protrusion is taken out of the first locking portion; or the first protrusion and the second protrusion are taken out of the first locking portion and the second locking portion.

7. The cleaner according to claim 6, further comprising an elastic member configured to provide an elastic force to the button such that the button rotates in a second direction opposite to the first direction.

8. The cleaner according to claim 1, wherein:

a dust container assembly comprises the dust separator and the dust container, and the cleaner further comprises a dust container fixer, the dust container fixer configured to prevent the dust container assembly from falling down by a weight of the dust container assembly based on the dust container assembly being released from the main body by the button.

9. The cleaner according to claim 8, wherein the dust container fixer comprises:

a sliding groove extending in a first direction, the sliding groove provided in the main body, a sliding protrusion inserted into the sliding groove to be slidable along the first direction, the sliding protrusion provided in the dust container, and a latching protrusion provided at one end of the sliding groove to restrict a movement of the sliding protrusion in the first direction.

10. The cleaner according to claim 9, wherein, based on the dust container assembly being released from the main body by the button, the sliding protrusion is caught by the latching protrusion such that the dust container assembly is prevented from falling down by a weight of the dust container assembly, and wherein the dust container assembly is separated from the main body in the first direction when a predetermined force that is greater than the weight of the dust container assembly is applied to the dust container assembly in the first direction.

11. The cleaner according to claim 9, wherein:

the sliding protrusion is further configured to be movable in a second direction intersecting the first direction, and the sliding protrusion is further configured to pass through the latching protrusion by moving in the second direction.

12. The cleaner according to claim 11, wherein:

the main body further comprises a sliding rail forming one surface of the sliding groove, the sliding rail extending in the first direction, and the sliding protrusion is further configured to pass through the sliding rail and be inserted into the sliding groove by moving in a third direction intersecting the first direction and the second direction.

13. The cleaner according to claim 12, wherein the sliding protrusion is further configured to pass through the sliding rail by moving in the second direction based on the sliding protrusion being inserted into the sliding groove in the third direction.

14. The cleaner according to claim 13, wherein the sliding protrusion comprises:

a first guide surface inclined with respect to the first direction to slide, the first guide surface configured to pass through the latching protrusion; and a second guide surface inclined with respect to the third direction to slide, the second guide surface configured to pass through the sliding rail.

15. A cleaner comprising:

a main body configured to suck air;

a dust separator detachably coupled to the main body, the dust separator configured to separate dust included in the air sucked into the main body;

a dust container detachably coupled to the dust separator, the dust container configured to store dust; and a button comprising:

a first protrusion configured to fix or release the dust separator to or from the main body, and a second protrusion configured to fix or release the dust container to or from the dust separator.

16. The cleaner according to claim 15, wherein:

the main body comprises a protrusion groove into which the first protrusion is inserted, the dust container comprises a button hole into which the second protrusion is inserted, and the button further comprises a third protrusion contacting a stopper provided in the main body, the third protrusion configured to restrict a movement range of the button.

17. The cleaner according to claim 16, wherein the third protrusion is further configured to restrict the second protrusion from being taken out of the button hole based on the first protrusion being taken out of the protrusion groove such that the dust separator is separated from the main body.

18. The cleaner according to claim 15, wherein:

a dust container assembly comprises the dust separator and the dust container, and the cleaner further comprises a dust container fixer configured to prevent the dust container assembly from falling down by a weight of the dust container assembly based on the dust container assembly is released from the main body by the button.

19. The cleaner according to claim 18, wherein, based on the dust container assembly being released from the main body by the button, the dust container assembly is prevented from falling down by the weight of the dust container assembly, and the dust container assembly is separated from the main body in a first direction based on a predetermined force greater than the weight of the dust container assembly being applied to the dust container assembly in the first direction.

20. A cleaner comprising:

a main body;

a dust separator detachably coupled to the main body;

a dust container detachably coupled to the dust separator, the dust container configured to be restricted from being separated from the dust separator based on the dust separator being coupled to the main body;

a button provided in the dust separator, the button configured to:

fix or release the dust separator to or from the main body, and fix or release the dust container to or from the dust separator; and a dust container fixer configured to prevent the dust container and the dust separator from falling down by weights of the dust container and the dust separator based on the dust container and the dust separator being released from the main body by the button.

* * * * *